US007427729B2

(12) United States Patent
Asakura et al.

(10) Patent No.: US 7,427,729 B2
(45) Date of Patent: Sep. 23, 2008

(54) IMAGE HEATING DEVICE AND IMAGE FORMING DEVICE

(75) Inventors: Kenji Asakura, Kyoto (JP); Noboru Katakabe, Uji (JP); Keisuke Fujimoto, Hirakata (JP); Masaru Imai, Hirakata (JP); Akihiro Yasuda, Katano (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 375 days.

(21) Appl. No.: 10/541,498

(22) PCT Filed: Dec. 22, 2003

(86) PCT No.: PCT/JP03/16430

§ 371 (c)(1),
(2), (4) Date: Jul. 7, 2005

(87) PCT Pub. No.: WO2004/063819

PCT Pub. Date: Jul. 29, 2004

(65) Prior Publication Data

US 2006/0147221 A1 Jul. 6, 2006

(30) Foreign Application Priority Data

Jan. 8, 2003 (JP) ..... 2003-002058

(51) Int. Cl.
*H05B 6/14* (2006.01)
*B30B 15/34* (2006.01)
*G03G 15/14* (2006.01)

(52) U.S. Cl. ..... 219/619; 100/300; 399/328

(58) Field of Classification Search ..... 219/619, 219/216, 618, 469, 671; 100/300, 301, 92; 399/328, 320, 330

See application file for complete search history.

(56) References Cited

U.S. PATENT DOCUMENTS 5,822,669 A 10/1998 Okabayashi et al.

(Continued)

FOREIGN PATENT DOCUMENTS

EP 0649072 6/1994

(Continued)

OTHER PUBLICATIONS

U.S. Appl. No. 10/542,006 to Asakura et al.

(Continued)

*Primary Examiner*—Daniel L Robinson
(74) *Attorney, Agent, or Firm*—Greenblum & Bernstein, P.L.C.

(57) ABSTRACT

An image heating apparatus is provided that enables the entire width of a heat-producing medium to be heated uniformly and an excessive rise in temperature to be prevented, without making the configuration complex. In a fixing unit 19 in which this apparatus is applied, a fixing belt 112 is an annular member that has an inner peripheral surface and an outer peripheral surface, and produces heat through the action of magnetic flux. An exciting coil 120 is located in proximity to the outer peripheral surface of fixing belt 112, and generates magnetic flux that acts upon fixing belt 112. A suppression member 650 is located in proximity to inner peripheral surface of fixing belt 112, and reduces, of the magnetic flux generated by exciting coil 120, magnetic flux that acts upon a paper non-passage area of fixing belt 112.

9 Claims, 17 Drawing Sheets

U.S. PATENT DOCUMENTS

| | | | | |
|---|---|---|---|---|
| 6,298,215 | B1 * | 10/2001 | Nomura et al. | 399/328 |
| 6,954,608 | B2 * | 10/2005 | Sekiguchi et al. | 399/334 |
| 7,027,764 | B2 * | 4/2006 | Sekiguchi et al. | 399/334 |
| 2006/0147221 | A1 * | 7/2006 | Asakura et al. | 399/69 |
| 2007/0014599 | A1 * | 1/2007 | Yasuda et al. | 399/328 |
| 2007/0014601 | A1 * | 1/2007 | Yasuda et al. | 399/329 |

FOREIGN PATENT DOCUMENTS

| | | |
|---|---|---|
| JP | 9-171889 | 6/1997 |
| JP | 10-74009 | 3/1998 |
| JP | 2000-235329 | 8/2000 |
| JP | 2001-125407 | 5/2001 |

OTHER PUBLICATIONS

English Language Abstract of JP 10-74009.
English Language Abstract of JP 2001-125407.
English Language Abstract of JP 9-235329.
English Language Abstract of JP 2000-0649072.

* cited by examiner

IMAGE HEATING DEVICE AND IMAGE FORMING DEVICE

TECHNICAL FIELD

The present invention relates to an image heating apparatus using an electromagnetic induction heating scheme for fixing an unfixed image, and an image forming apparatus such as an electrophotographic apparatus or electrostatographic apparatus that uses that image heating apparatus.

BACKGROUND ART

An example of an image heating apparatus that uses an electromagnetic induction heating method is disclosed in Unexamined Japanese Patent Publication No. HEI 10-74009.

FIG. 1 is an oblique drawing of an image heating apparatus disclosed in Unexamined Japanese Patent Publication No. HEI 10-74009, showing an example of an image heating apparatus that uses a magnetic flux absorption member that absorbs magnetic flux.

In FIG. 1, reference number 1 indicates a metal sleeve that produces heat by means of induction heating. Metal sleeve 1 is mounted on, and supported in a rotatable fashion by, the outer periphery of a cylindrical guide 7. Reference number 2 indicates a pressure roller that exerts pressure on metal sleeve 1. An unfixed toner image formed on recording paper 8 is heat-fixed when recording paper 8 passes through the nip area (pressure area) between metal sleeve 1 and pressure roller 2. Reference number 4 indicates an exciting coil that is installed inside of guide 7 and generates a high-frequency magnetic field, and reference numbers 6*a* and 6*b* indicate magnetic flux absorption members that are located on the outside of metal sleeve 1 and absorb magnetic flux.

Recording paper 8 bearing an unfixed toner image is transported to the nip area in the direction indicated by the arrow S. A fixed toner image is then formed on recording paper 8 by the heat of metal sleeve 1 and the pressure between metal sleeve 1 and pressure roller 2. In this example, recording paper 8 is transported with a reference position at its right-hand side in FIG. 8, and if the paper width varies, the left-hand side in FIG. 8 is a paper non-passage area.

As shown in FIG. 1, magnetic flux absorption member 6*b* on the left-hand side is configured so as to be capable of parallel movement in the axial direction along a rail 5 through rotation of a motor 3.

When wide recording paper 8 is passed through, magnetic flux absorption member 6*b* is placed in a position facing metal sleeve 1 without the intermediation of magnetic flux absorption member 6*a*.

On the other hand, when narrow recording paper 8 is passed through, magnetic flux absorption member 6*b* is moved to the rear of magnetic flux absorption member 6*a* as shown in FIG. 2. By this means, magnetic flux reaching metal sleeve 1 from exciting coil 4 in the paper non-passage area is reduced. Therefore, the calorific value of the ends of metal sleeve 1 is suppressed.

Thus, the temperature rise in the paper non-passage area of metal sleeve 1 is reduced according to the width of recording paper 8.

However, with the image heating apparatus shown in FIG. 1, in order to perform parallel movement of magnetic flux absorption member 6*b*, the distance between movable magnetic flux absorption member 6*b* and metal sleeve 1 and the distance between magnetic flux absorption member 6*a* and metal sleeve 1 are different, as shown in FIG. 2. Consequently, a difference tends to occur between the calorific values of the part where movable magnetic flux absorption member 6*b* is facing metal sleeve 1 and the part where magnetic flux absorption member 6*a* is facing metal sleeve 1. Therefore, it is not easy to heat the entire width of metal sleeve 1 uniformly.

FIG. 3 is an oblique drawing of another image heating apparatus disclosed in Unexamined Japanese Patent Publication No. HEI 10-74009, showing an example of an image heating apparatus that uses a magnetic flux shielding plate as a means of reducing magnetic flux acting upon metal sleeve 1.

In the conventional image heating apparatus shown in FIG. 3, a magnetic flux shielding plate 9 is positioned so as to be in line with the inner surface of a holder 10 between metal sleeve 1 and exciting coil 4. Then, when narrow recording paper 8 is passed through, magnetic flux shielding plate 9 is moved to a position where it covers exciting coil 4 over an axial direction range equivalent to the paper non-passage area of metal sleeve 1, and when wide recording paper 8 is passed through, magnetic flux shielding plate 9 is retracted to the outer edge of the paper passage width of metal sleeve 1. Thus, the entire width of metal sleeve 1 is heated uniformly when wide recording paper 8 is passed through.

However, in the image heating apparatus shown in FIG. 3, since magnetic flux shielding plate 9 is installed so as to be in line with the inner surface of holder 10 between metal sleeve 1 and exciting coil 4, magnetic flux masking shield 9 must be made thin. When magnetic flux shielding plate 9 is made thin, heat production due to induction heating increases. Moreover, as holder 10 is generally of a plastic material with low thermal conductivity, there is little heat dissipation from magnetic flux shielding plate 9 to holder 10. There is consequently a possibility that magnetic flux shielding plate 9 will continue to rise in temperature.

Furthermore, a problem with the image heating apparatus shown in FIG. 1 is that a mechanism is necessary to perform parallel movement of magnetic flux absorption member 6*b*, making the configuration of the overall apparatus complex and large.

DISCLOSURE OF INVENTION

It is an object of the present invention to provide an image heating apparatus that enables the entire width of a heat-producing member to be heated uniformly and an excessive rise in temperature to be prevented, without making the configuration complex.

According to one mode of the present invention, an image heating apparatus has an annular heat-producing member that has a pair of principal surfaces and produces heat through the action of magnetic flux; a magnetic flux generation section that is located in proximity to the first principal surface of the pair of principal surfaces and generates magnetic flux that acts upon the heat-producing member; and a magnetic flux reduction section that is located in proximity to the second principal surface of the pair of principal surfaces and reduces, of the magnetic flux generated by the magnetic flux generation section, magnetic flux that acts upon a paper non-passage area of the heat-producing member.

According to another mode of the present invention, an image heating apparatus is equipped with an induction-heated thin heat-producing member that transfers heat directly or indirectly to a heated medium that moves with an image; an excitation section that generates magnetic flux and induction-heats the heat-producing member; a temperature control section that controls the excitation section and makes the temperature of a contact surface that comes into contact with the heated medium a predetermined temperature; and a heat production adjustment section that is located on the opposite side of the heat-producing member relative to the excitation section, and adjusts heat production distribution of the heat-producing member by adjusting the magnetic flux acting upon the heat-producing member; wherein the heat production adjustment section has an opposed core of ferromagnetic material whose temperature varies according to the temperature of the heat-producing member and whose Curie point is in the range of −10° C. to +100° C. relative to the maximum value of the predetermined temperature.

According to yet another mode of the present invention, an image heating apparatus is equipped with an induction-heated thin heat-producing member that transfers heat directly or indirectly to a heated medium that moves with an image; an excitation section that generates magnetic flux and induction-heats the heat-producing member; a temperature control section that controls the excitation section and makes the temperature of a fixing surface that comes into contact with the heated medium a predetermined temperature; and a heat production adjustment section that is located on the opposite side of the heat-producing member relative to the excitation section, and adjusts heat production distribution of the heat-producing member by adjusting the magnetic flux acting upon the heat-producing member; wherein the heat production adjustment section has an opposed core of ferromagnetic material whose temperature varies according to the temperature of the heat-producing member and whose Curie point is in the range of 140° C. to 250° C.

According to a still further mode of the present invention, an image heating apparatus is equipped with an induction-heated thin heat-producing member that transfers heat directly or indirectly to a heated medium that moves with an image; an excitation section that generates magnetic flux and induction-heats the heat-producing member; a temperature control section that controls the excitation section and makes the temperature of a fixing surface that comes into contact with the heated medium a predetermined temperature; and a heat production adjustment section that is located on the opposite side of the heat-producing member relative to the excitation section, and adjusts heat production distribution of the heat-producing member by adjusting the magnetic flux acting upon the heat-producing member; wherein the heat production adjustment section has a switching section that performs on/off switching of a suppression coil composed of an electrical conductor that is linked to the magnetic flux.

According to a still further mode of the present invention, an image heating apparatus is equipped with an induction-heated thin, cylindrical heat-producing member that transfers heat directly or indirectly to a heated medium that moves with an image; an excitation section that faces the outer peripheral surface of the heat-producing member, generates magnetic flux, and induction-heats the heat-producing member; a temperature control section that controls the excitation section and makes the temperature of a fixing surface that comes into contact with the heated medium a predetermined temperature; and a heat production adjustment section that is located on the opposite side of the heat-producing member relative to the excitation section, and adjusts heat production distribution of the heat-producing member by adjusting the magnetic flux acting upon the heat-producing member; wherein the heat production adjustment section has a rotatable opposed core of ferromagnetic material whose cross-sectional shape varies in the axial direction of the heat-producing member.

According to a still further mode of the present invention, an image heating apparatus is equipped with an induction-heated thin, cylindrical heat-producing member that transfers heat directly or indirectly to a heated medium that moves with an image; an excitation section that faces the outer peripheral surface of the heat-producing member, generates magnetic flux, and induction-heats the heat-producing member; a temperature control section that controls the excitation section and makes the temperature of a fixing surface that comes into contact with the heated medium a predetermined temperature; and a heat production adjustment section that is located on the opposite side of the heat-producing member relative to the excitation section, and adjusts heat production distribution of the heat-producing member by adjusting the magnetic flux acting upon the heat-producing member; wherein the heat production adjustment section has a rotatable opposed core which consists of divided ferromagnetic materials and has a cross-sectional shape varying in the axial direction of the heat-producing member.

According to a still further mode of the present invention, an image heating apparatus is equipped with an induction-heated thin, cylindrical heat-producing member that transfers heat directly or indirectly to a heated medium that moves with an image; an excitation section that generates magnetic flux and induction-heats the heat-producing member; a temperature control section that controls the excitation section and makes the temperature of a fixing surface that comes into contact with the heated medium a predetermined temperature; and a heat production adjustment section that is located on the opposite side of the heat-producing member relative to the excitation section, and adjusts heat production distribution of the heat-producing member by adjusting the magnetic flux acting upon the heat-producing member; wherein the heat production adjustment section has a movable magnetic flux suppression member of low-resistivity material.

According to a still further mode of the present invention, an image heating apparatus is equipped with an induction-heated thin heat-producing member that transfers heat directly or indirectly to a heated medium that moves with an image; an excitation section that generates magnetic flux and induction-heats the heat-producing member; a temperature control section that controls the excitation section and makes the temperature of a contact surface that comes into contact with the heated medium a predetermined temperature; and a heat production adjustment section that is located on the opposite side of the heat-producing member relative to the excitation section, and adjusts heat production distribution of the heat-producing member by adjusting the magnetic flux acting upon the heat-producing member; wherein the heat production adjustment section has an opposed core of ferromagnetic material, and the Curie point of the opposed core is set higher than the temperature of the opposed core in a paper passage area and lower than the temperature of the opposed core in a paper non-passage area.

According to a still further mode of the present invention, an image heating apparatus is equipped with an induction-heated thin heat-producing member that transfers heat directly or indirectly to a heated medium that moves with an image; an excitation section that generates magnetic flux and induction-heats the heat-producing member; a temperature control section that controls the excitation section and makes the temperature of a contact surface that comes into contact with the heated medium a predetermined temperature; and an opposed core of ferromagnetic material that is located on the opposite side of the heat-producing member relative to the excitation section, and adjusts heat production distribution of the heat-producing member by adjusting the magnetic flux acting upon the heat-producing member; wherein the distance between the heat-producing member and the opposed core is set constant in the area facing the exciting section.

According to a still further mode of the present invention, an image heating apparatus is equipped with an induction-heated thin heat-producing member that transfers heat directly or indirectly to a heated medium that moves with an image; an excitation section that generates magnetic flux and induction-heats the heat-producing member; a temperature control section that controls the excitation section and makes the temperature of a contact surface that comes into contact with the heated medium a predetermined temperature; and an opposed core of ferromagnetic material that is located on the opposite side of the heat-producing member relative to the excitation section, and adjusts heat production distribution of the heat-producing member by adjusting the magnetic flux acting upon the heat-producing member; wherein the distance between the heat-producing member and the opposed core in a paper non-passage area is set greater than the distance between the heat-producing member and the opposed core in a paper passage area.

According to a still further mode of the present invention, an image heating apparatus is equipped with an induction-heated thin heat-producing member that transfers heat directly or indirectly to a heated medium that moves with an image; an excitation section that generates magnetic flux and induction-heats the heat-producing member; a temperature control section that controls the excitation section and makes the temperature of a contact surface that comes into contact with the heated medium a predetermined temperature; and an opposed core of ferromagnetic material that is located on the opposite side of the heat-producing member relative to the excitation section, and adjusts heat production distribution of the heat-producing member by adjusting the magnetic flux acting upon the heat-producing member; wherein the area of the opposed core facing the heat-producing member in a paper non-passage area is set larger than the area of the opposed core facing the heat-producing member in a paper passage area.

BEST MODE FOR CARRYING OUT THE INVENTION

Figure 1:
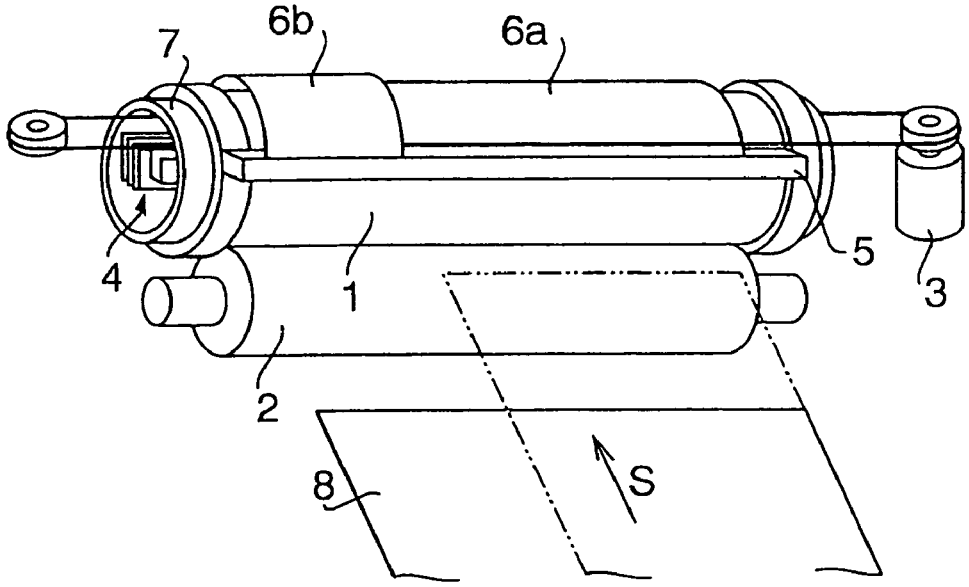
PRIOR ART FIG. 1
FIG. 1 is an oblique drawing showing an example of a conventional image heating apparatus.
Figure 2:
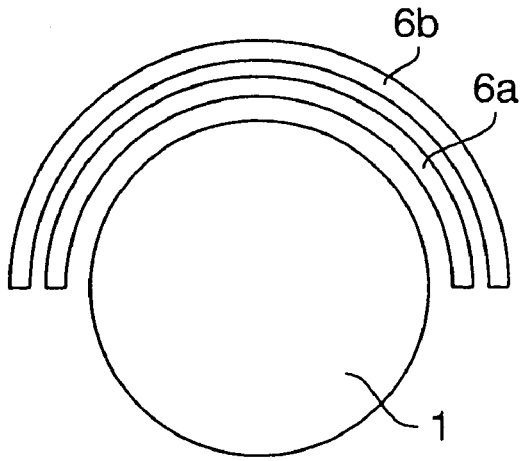
PRIOR ART FIG. 2
FIG. 2 is a side view of a magnetic flux absorption member installed in the image heating apparatus in FIG. 1.
Figure 3:
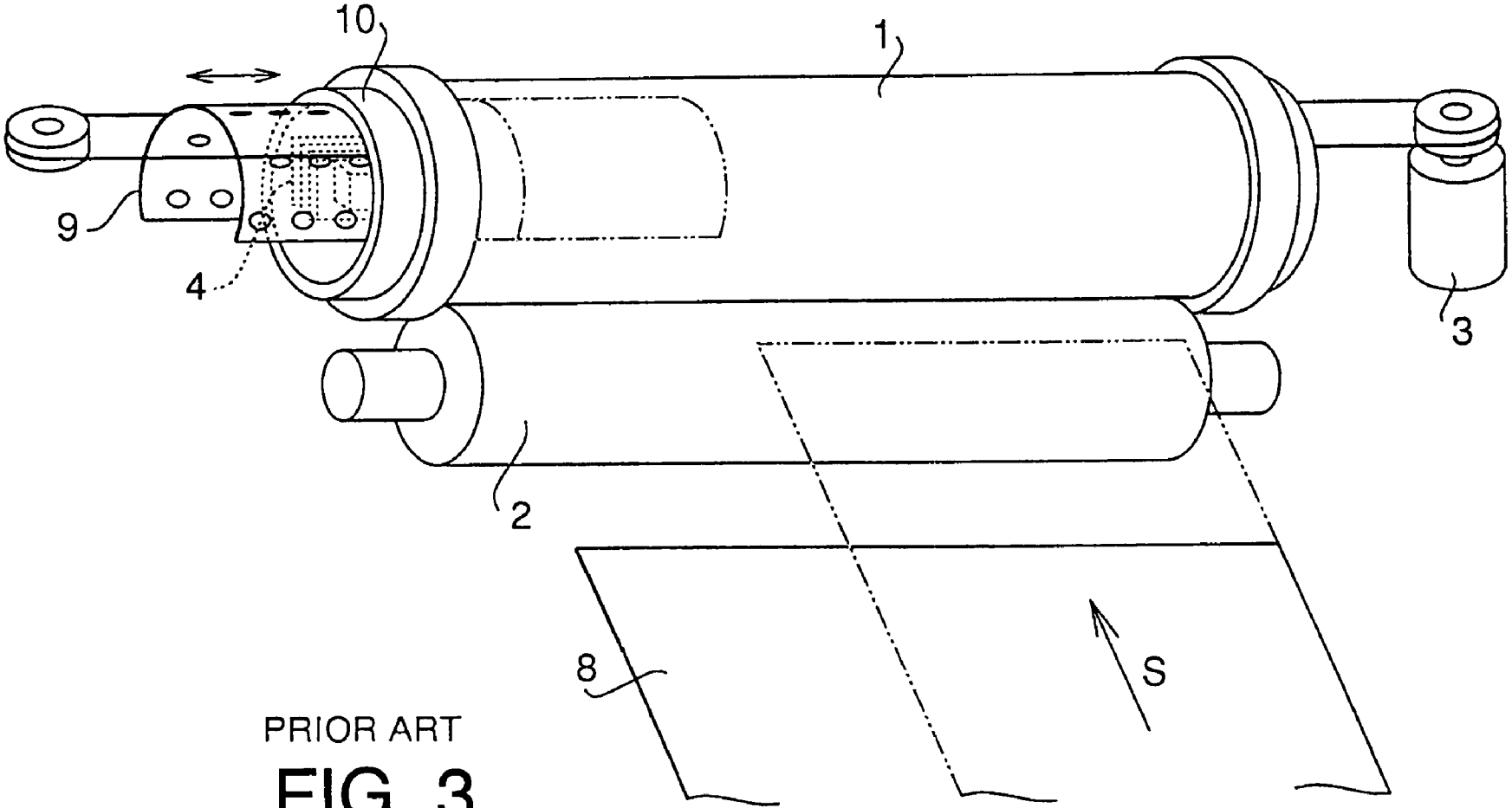
PRIOR ART FIG. 3
FIG. 3 is an oblique drawing showing another example of a conventional image heating apparatus.

An image heating apparatus of the present invention is equipped with an induction-heated thin heat-producing member that transfers heat directly or indirectly to a heated medium that moves with an image; an excitation section that generates magnetic flux and induction-heats the heat-producing member; a temperature control section that controls the excitation section and makes the temperature of a contact surface that comes into contact with the heated medium a predetermined temperature; and a heat production adjustment section that is located on the opposite side of the heat-producing member relative to the excitation section, and adjusts heat production distribution of the heat-producing member by adjusting the magnetic flux acting upon the heat-producing member; wherein the heat production adjustment section has an opposed core of ferromagnetic material whose temperature varies according to the temperature of the heat-producing member and whose Curie point is in the range of −10° C. to +100° C. relative to the maximum value of the predetermined temperature.

By this means, it is possible to prevent an excessive temperature rise whereby a paper non-passage area becomes excessively hot, without a member that moves mechanically.

Also, at or below a predetermined temperature, magnetic coupling between the heat-producing member and excitation member is good, and therefore the efficiency of induction heating that heats the heat-producing member is high. Moreover, magnetic flux distribution is continuously variable in accordance with axial direction temperature distribution by recording paper of any width. Furthermore, magnetic flux penetrating the heat-producing member can be prevented from leaking inside or outside the apparatus.

Also, an image heating apparatus of the present invention is equipped with an induction-heated thin heat-producing member that transfers heat directly or indirectly to a heated medium that moves with an image; an excitation section that generates magnetic flux and induction-heats the heat-producing member; a temperature control section that controls the excitation section and makes the temperature of a fixing surface that comes into contact with the heated medium a predetermined temperature; and a heat production adjustment section that is located on the opposite side of the heat-producing member relative to the excitation section, and adjusts heat production distribution of the heat-producing member by adjusting the magnetic flux acting upon the heat-producing member; wherein the heat production adjustment section has an opposed core of ferromagnetic material whose temperature varies according to the temperature of the heat-producing member and whose Curie point is in the range of 140° C. to 250° C.

By this means, it is possible to prevent an excessive temperature rise whereby a paper non-passage area becomes excessively hot without a member that moves mechanically. Also, at or below a predetermined temperature, magnetic coupling between the heat-producing member and excitation member is good, and therefore the efficiency of induction heating that heats the heat-producing member is high. Moreover, magnetic flux distribution is continuously variable in accordance with axial direction temperature distribution by recording paper of any width. Furthermore, magnetic flux penetrating the heat-producing member can be prevented from leaking inside or outside the apparatus.

It is desirable for the heat production adjustment section to be in contact with the heat-producing member or a member heated by the heat-producing member. By this means, the temperature of the magnetic flux adjustment section changes more quickly in response to a change in temperature of the heat-producing member. Consequently, an excessive temperature rise of the heat-producing member can be prevented rapidly.

The heat production adjustment section is facing and at a distance from the heat-producing member or a member heated by the heat-producing member, and it is desirable for this distance to be not less than 0.3 mm and not more than 2 mm. By this means, the temperature of the magnetic flux adjustment section changes more quickly in response to a change in temperature of the heat-producing member. Consequently, an excessive temperature rise of the heat-producing member can be prevented rapidly. Also, contact of a member facing the heat production adjustment member can be prevented. Also, magnetic coupling between the heat-producing member and excitation member is good, and therefore the efficiency of induction heating that heats the heat-producing member is high.

It is also desirable for the infrared emissivity of at least one of the opposed surfaces opposing and brought into proximity at the aforementioned distance to be not less than 0.8 and not more than 1.0. By this means, heat transfer by infrared rays is increased, and the temperature of the magnetic flux adjustment section changes more quickly in response to a change in temperature of the heat-producing member. Consequently, an excessive temperature rise of the heat-producing member can be prevented rapidly.

An image heating apparatus of the present invention is equipped with an induction-heated thin heat-producing member that transfers heat directly or indirectly to a heated medium that moves with an image; an excitation section that generates magnetic flux and induction-heats the heat-producing member; a temperature control section that controls the excitation section and makes the temperature of a fixing surface that comes into contact with the heated medium a predetermined temperature; and a heat production adjustment section that is located on the opposite side of the heat-producing member relative to the excitation section, and adjusts heat production distribution of the heat-producing member by adjusting the magnetic flux acting upon the heat-producing member; wherein the heat production adjustment section has a suppression coil composed of an electrical conductor that is linked to the magnetic flux, and a switching section that performs on/off switching of the suppression coil.

By this means, it is possible to prevent an excessive temperature rise whereby a paper non-passage area becomes excessively hot, without a member that moves mechanically. Also, installation on the opposite side of the heat-producing member means that the current and voltage induced in the suppression coil are small. By this means, it is possible for heat production of the suppression coil to be made small, and at the same time for the withstand voltage and current capacity of the switching section to be made small. As a result, an inexpensive and simple configuration can be implemented.

Also, with regard to the heat production adjustment section, it is desirable for an opposed core of high-permeability material through which magnetic flux linked to the suppression coil passes to be located inside the suppression coil and/or on the opposite side with respect to the heat-producing member.

By this means, magnetic coupling between the excitation section and suppression coil is improved, and the action of the suppression coil due to switching by the switching section is increased.

An image heating apparatus of the present invention is equipped with an induction-heated thin, cylindrical heat-producing member that transfers heat directly or indirectly to a heated medium that moves with an image; an excitation section that faces the outer peripheral surface of the heat-producing member, generates magnetic flux, and induction-heats the heat-producing member; a temperature control section that controls the excitation section and makes the temperature of a fixing surface that comes into contact with the heated medium a predetermined temperature; and a heat production adjustment section that is located on the opposite side of the heat-producing member relative to the excitation section, and adjusts heat production distribution of the heat-producing member by adjusting the magnetic flux acting upon the heat-producing member; wherein the heat production adjustment section has a rotatable, unified opposed core of ferromagnetic material whose cross-sectional shape varies in the axial direction of the heat-producing member.

By this means, it is possible to prevent an excessive temperature rise whereby a paper non-passage area becomes excessively hot, by rotating the unified opposed core, enabling the mechanical configuration to be made simple and inexpensive, and at the same time enabling the apparatus to be made small. Also, the intensity of heat production distribution can be varied arbitrarily by varying the rotational phase of the axis.

It is also desirable for the distance between the heat-producing member and the opposed core to be fixed in the axial direction at least one part in the circumferential direction of the opposed core. By this means, when this part is positioned to face the excitation section, uniform and highly efficient heating is possible.

It is also desirable for heat production distribution to be possible whereby the intensity of heat production distribution regulated by the opposed core reverses the intensity by rotation of the opposed core. By means of this configuration, after only a narrow range has been heated up when narrow paper is used, the low-temperature part outside that range can be heated intensively. By this means, when using narrow paper, the heating-up energy is small and at the same time a short-time heating-up is possible. Also, uniform and high-quality images can be obtained even if wide paper is passed through immediately after-narrow paper is passed through.

An image heating apparatus of the present invention is equipped with an induction-heated thin, cylindrical heat-producing member that transfers heat directly or indirectly to a heated medium that moves with an image; an excitation section that faces the outer peripheral surface of the heat-producing member, generates magnetic flux, and induction-heats the heat-producing member; a temperature control section that controls the excitation section and makes the temperature of a fixing surface that comes into contact with the heated medium a predetermined temperature; and a heat production adjustment section that is located on the opposite side of the heat-producing member relative to the excitation section, and adjusts heat production distribution of the heat-producing member by adjusting the magnetic flux acting upon the heat-producing member; wherein the heat production adjustment section has a rotatable opposed core which consists of divided ferromagnetic materials and has a cross-sectional shape varying in the axial direction of the heat-producing member.

By this means, the intensity of heat production distribution is varied for each part by varying the rotational phase of the divided opposed cores, and therefore the flexibility of heat production distribution to be set for a combination of the divided opposed cores is greater than that for the unified opposed core.

With regard to the opposed core, it is also desirable for at least one part in the axial direction of the heat-producing member to be formed by combining a plurality of materials of different permeability. By this means, adjustment of the calorific value can be performed by means of both rotational phase and material, enabling the possible heat production distribution intensity setting range to be extended. Also, the cross-sectional shape of the opposed core can be fixed in the axial direction, enabling thermal capacity distribution inside the heat-producing member to be made uniform. By this means, uniform temperature distribution of the heat-producing member can easily be achieved.

It is desirable for the opposed core to be formed by combining at least a ferromagnetic material and a low-permeability electrical conductor. By this means, magnetic circuit variations due to opposed core rotation are increased, extending the heat production distribution intensity control range. Also, inductive magnetic flux leakage can be suppressed.

It is also desirable for the electrical conductor to have a thickness of not less than 0.2 mm and not more than 3 mm in the radial direction of the heat-producing member. By this means, electrical conductor heat production can be prevented, and at the same time a small distance can be set between the opposed core and heat-producing member, enabling the magnetic coupling of the induction heating section to be increased.

Furthermore, it is desirable for the cross-sectional shape of the opposed core to vary continuously in the axial direction in at least one part of the axial direction of the heat-producing member. By this means, calorific value distribution can be adjusted continuously in the axial direction by the angle of rotation of the opposed core. Consequently, the maximum necessary heat production area can be set for a plurality of paper widths.

According to a still further mode of the present invention, an image heating apparatus is equipped with an induction-heated thin, cylindrical heat-producing member that transfers heat directly or indirectly to a heated medium that moves with an image; an excitation section that generates magnetic flux and induction-heats the heat-producing member; a temperature control section that controls the excitation section and makes the temperature of a fixing surface that comes into contact with the heated medium a predetermined temperature; and a heat production adjustment section that is located on the opposite side of the heat-producing member relative to the excitation section, and adjusts heat production distribution of the heat-producing member by adjusting the magnetic flux acting upon the heat-producing member; wherein the heat production adjustment section has a movable magnetic flux suppression member of low-resistivity material.

By this means, heat production distribution control is possible without expensive magnetic material. Also, magnetic flux penetrating the heat-producing member can be prevented from leaking inside or outside the apparatus. Furthermore, installation on the opposite side of the heat-producing member means that there is little magnetic flux acting upon the magnetic flux reduction section, and therefore magnetic flux reduction member heat production is small. As a result, the efficiency of induction heating that heats the heat-producing member is high.

It is desirable for an opposed core of ferromagnetic material to be provided on the opposite side of the magnetic flux suppression member relative to the heat-producing member. By this means, the heat production distribution intensity control range through movement of the magnetic flux suppression member is extended.

It is also desirable for the magnetic flux suppression member to have a thickness of 0.1 mm or above in the radial direction of the heat-producing member. By this means, the magnetic flux suppression member can prevent heat production due to inductive magnetic flux, and the efficiency of induction heating that heats the heat-producing member is increased.

An image forming apparatus of the present invention is equipped with an above-described image heating apparatus, and the image heating apparatus fixes a toner image held on recording paper. By this means, the axial direction calorific value can be controlled to any distribution. Therefore, it is possible to prevent an excessive temperature rise of a paper non-passage area with a simple and inexpensive configuration even when narrow recording paper is used, and also to obtain a high-quality fixed image when wide paper is used.

It is desirable for an image forming apparatus of the present invention to be equipped with an above-described image heating apparatus; a first temperature sensor that is located in a range through which all kinds of applicable paper widths pass, and measures a temperature signal sent to a temperature control section; and a second temperature sensor that is located in a range through which paper with the smallest applicable paper width passes, and at least measures a temperature signal sent to the heat production adjustment section; and for the heat production adjustment section to adjust the heat production distribution of the heat-producing member based on a signal from the second temperature sensor.

By this means, the axial direction calorific value can be adjusted rapidly to any distribution with respect to the temperature of the heat-producing member. Therefore, it is possible to prevent an excessive temperature rise of a paper non-passage area with a simple and inexpensive configuration even when narrow recording paper is used, and also to obtain a high-quality fixed image when wide paper is used.

With reference now to the accompanying drawings, embodiments of the present invention will be explained in detail below. In all the following embodiments, a case is described in which an image heating apparatus of the present invention is used as a fixing unit for fixing an unfixed image, and that fixing unit is used in an image forming apparatus such as an electrophotographic apparatus or electrostatographic apparatus, for example.

Embodiment 1

Figure 4:
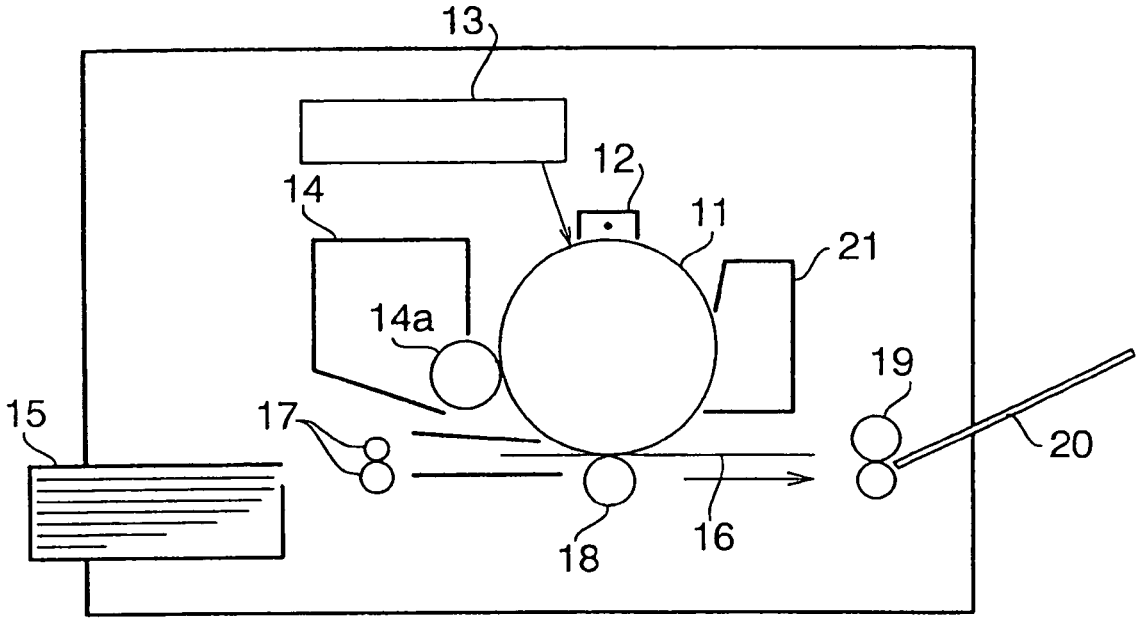
FIG. 4 is a cross-sectional drawing showing an example of the general configuration of an image forming apparatus that uses an image heating apparatus according to Embodiment 1 of the present invention as a fixing unit.
Figure 5:
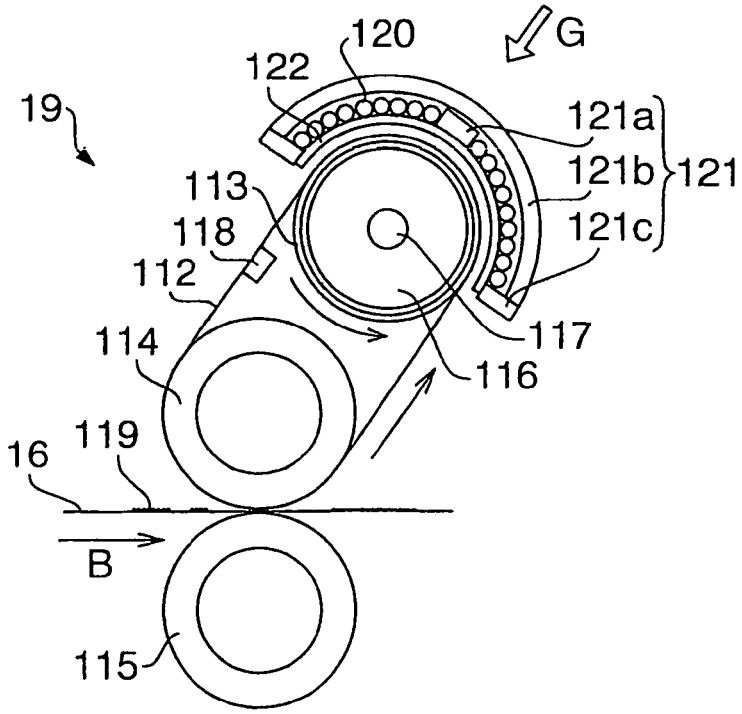
FIG. 5 is a cross-sectional drawing of a fixing unit according to Embodiment 1 of the present invention.
Figure 6:
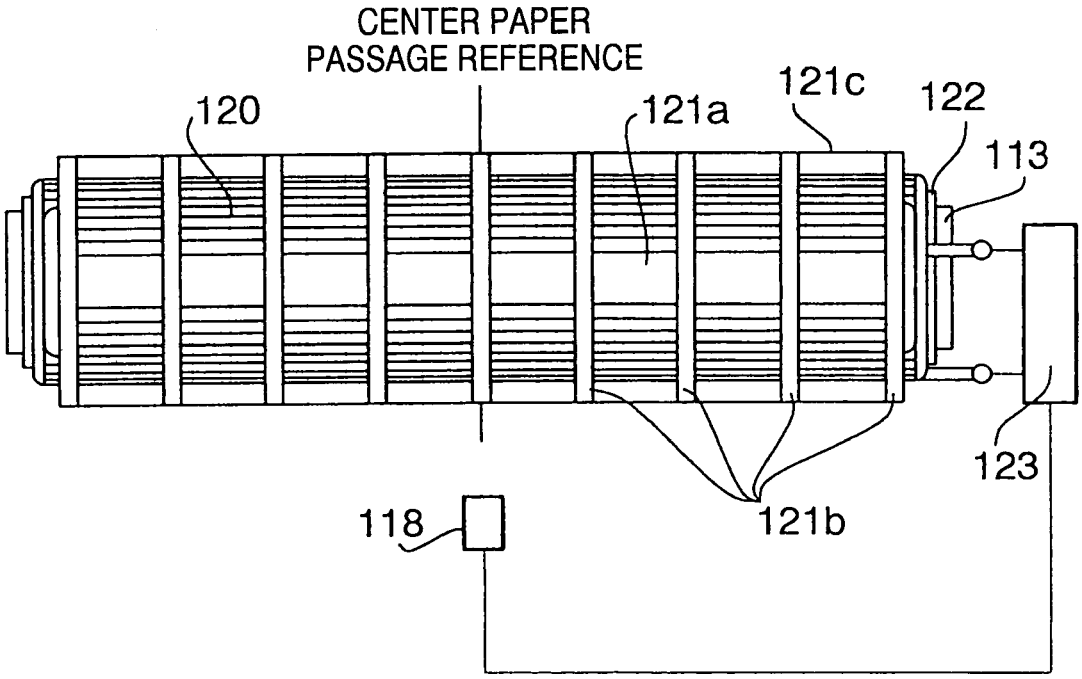
FIG. 6 is a rear view of a fixing unit viewed from the direction indicated by arrow G in FIG. 5.
Figure 7:
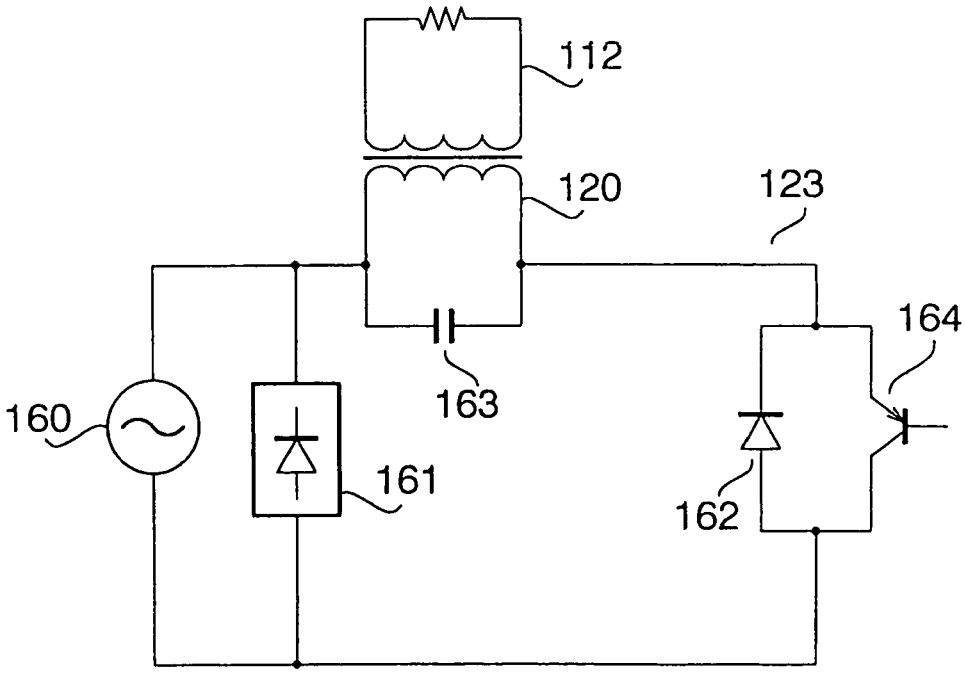
FIG. 7 is a circuit diagram showing the basic configuration of the exciting circuit of a fixing unit according to Embodiment 1 of the present invention.
Figure 8:
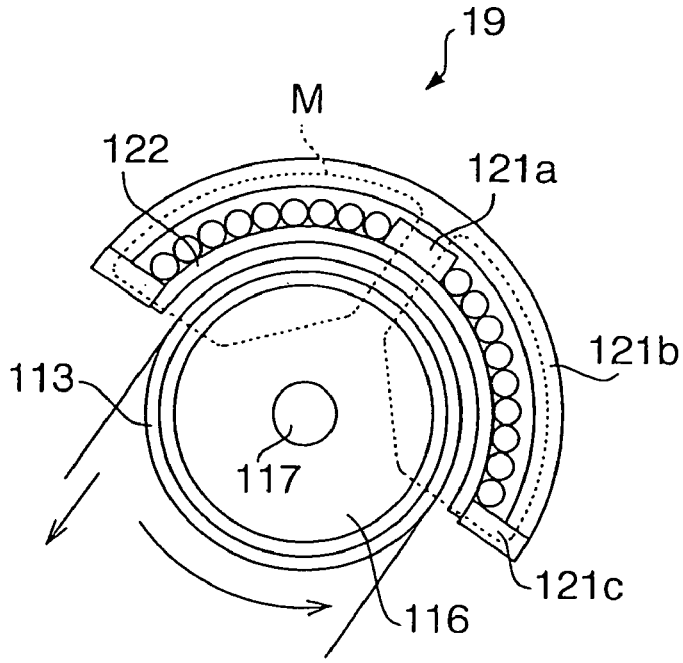
FIG. 8 is an explanatory drawing of the electromagnetic induction action in a fixing unit according to Embodiment 1 of the present invention.

FIG. 4 is a cross-sectional drawing showing an example of the general configuration of an image forming apparatus that uses a fixing unit according to Embodiment 1 of the present invention. FIG. 5 is a cross-sectional drawing of the fixing unit according to this embodiment shown in FIG. 4, FIG. 6 is a rear view of a fixing unit according to this embodiment viewed from the direction indicated by arrow G in FIG. 5, FIG. 7 is a circuit diagram showing the basic configuration of the exciting circuit of a fixing unit according to this embodiment, FIG. 8 is a drawing explaining the heat production action, and FIG. 9 through FIG. 12 are cross-sectional drawings showing different sample modes of a fixing unit according to this embodiment.

The configuration and operation of this apparatus will now be described. Reference number 11 indicates an electrophotographic photosensitive body (hereinafter referred to as "photosensitive drum"). The surface of photosensitive drum 11 is charged uniformly by a charger 12 while photosensitive drum 11 is rotated at a fixed peripheral velocity in the direction indicated by the arrow.

Reference number 13 indicates a laser beam scanner. Laser beam scanner 13 outputs a laser beam modulated in accordance with a time series electrical digital pixel signal of image information input from a host apparatus such as an image reading apparatus or computer (not shown). The surface of photosensitive drum 11 uniformly charged as described above undergoes selective scanning exposure by this laser beam, whereby an electrostatic latent image conforming to the image information is formed on the surface of photosensitive drum 11.

This electrostatic latent image is then supplied with powdered toner charged by a developing device 14 that has a rotated developing roller 14*a*, and is developed as a toner image.

Meanwhile, recording paper 16 is fed one after another from a paper feed section 15. Recording paper 16 is transported at appropriate timing synchronized with the rotation of photosensitive drum 11 through registration rollers 17 to a transfer section composed of photosensitive drum 11 and a transfer roller 18 in contact with photosensitive drum 11. Through the agency of transfer roller 18 to which a transfer bias voltage is applied, the toner image on photosensitive drum 11 is successively transferred to recording paper 16. After passing through the transfer section, recording paper 16 is separated from photosensitive drum 11 and input to fixing unit 19 functioning as an image heating apparatus, where fixing of the transferred toner image is performed. Recording paper 16 on which an image has been fixed by the fixing process is output to an ejection tray 20.

After separation of recording paper 16, the surface of photosensitive drum 11 is cleaned by having residual matter such as remaining transferred toner removed by a cleaning apparatus 21, and is ready for the next image forming operation.

In this embodiment, a center-based paper feed scheme is used—that is, a method whereby both narrow paper and wide paper are transported with their center line in the width direction coinciding with the center position in the rotating axis direction of fixing unit 19.

Fixing unit 19 in the above-described image forming apparatus will now be described in detail. Reference number 112 indicates a fixing belt serving as a thin, endless heat-producing member. Fixing belt 112 is made of polyimide resin in which conductive powder is dispersed to provide electrical conductivity, and has a JIS (Japanese Industrial Standards) –A25 degree, 150 μm silicone rubber layer laid upon a 45 mm diameter, 100 μm thick base material surface, and a 20 μm thick fluororesin release layer further laid upon this silicone rubber layer. However, the configuration of fixing belt 112 is not limited to this. For example, heat-resistant fluororesin, PPS (polyphenylene sulfide), or a similar material in which conductive powder is dispersed, or electroformed thin metal such as nickel or stainless steel, can be used as the base material. Also, the surface release layer is not limited to fluororesin. For example, resin or rubber with good release characteristics such as PTFE (polytetrafluoroethylene), PFA (tetrafluoroethylene-perfluoroalkylvinyl ether copolymer), FEP (fluorinated ethylene propylene copolymer), or the like, may be used, alone or mixed, for the surface release layer.

It is desirable for the thickness of the heat-producing layer to be more than twice as thin as the skin depth corresponding to an induction heating high-frequency current. If the heat-producing layer is thicker than this, magnetic flux for induction heating will not penetrate the heat-producing member, and consequently the effect of the magnetic flux adjustment section provided on the opposite side of the heat-producing member from the excitation section will decrease.

Reference number 113 indicates a retaining roller. Retaining roller 113 is made of a resin such as PPS, which is an insulating material, and has a diameter of 20 mm and thickness of 0.3 mm. The outer peripheral surface at either end of retaining roller 113 is supported in a rotatable fashion by bearings (not shown). Ribs (not shown) to prevent snaking of fixing belt 112 are also provided at either end of retaining roller 113.

Reference number 114 indicates a 30 mm diameter low-thermal-conductivity fixing roller whose surface is of elastic foam silicone rubber of low hardness (Asker C45 degrees).

Fixing belt 112 is suspended between retaining roller 113 and fixing roller 114 under predetermined tension, and is moved in the direction indicated by the arrow.

Reference number 115 indicates a pressure roller functioning as a pressure section. Pressure roller 115 has an external diameter of ϕ30 mm and a surface of silicone rubber with a hardness of JIS−A60 degrees. As shown in the drawing, pressure roller 115 presses against fixing belt 112, forming a nip between pressure roller 115 and pressure roller 115. Pressure roller 115 is rotated by a drive section (not shown) of the main body of the apparatus. Fixing belt 112 and fixing roller 114 are driven around by the rotation of pressure roller 115. To increase wear resistance and releasability, the surface of pressure roller 115 may be covered with PFA, PTFE, FEP, or similar rubber or resin, alone or mixed.

Reference number 120 indicates an exciting coil functioning as an excitation section that induction-heats fixing belt 112. The configuration of exciting coil 120 will be described in detail later herein.

Reference number 116 indicates an opposed core (magnetic flux adjustment section) of a material (such as ferrite, for example) that has insulating properties and also has magnetic permeability and thermal conductivity of predetermined levels or higher. In this embodiment, the material of opposed core 116 is ferrite. Opposed core 116 is installed by being fixed to a spindle 117. For the ferrite material of opposed core 116, the Curie point at which ferromagnetism is lost is set at 190° C. The clearance between opposed core 116 and the inner peripheral surface of retaining roller 113 is 0.5 mm. Opposed core 116 of this embodiment is of uniform cylindrical shape in its axial direction. The facing surfaces of opposed core 116 and retaining roller 113 are black. Reference number 119 indicates a toner image formed on recording paper 16, and reference number 118 indicates a temperature sensor that measures the temperature of fixing belt 112 for temperature control.

In fixing unit 19 of this embodiment, the maximum width of recording paper that can pass through is assumed to be the short side (297 mm in length) of JIS standard A3 paper.

Reference number 120 indicates the exciting coil functioning as the excitation section. Exciting coil 120 is formed of 9 turns of a wire bundle comprising 100 copper wires with an external diameter of 0.15 mm and an insulated surface.

As shown in FIG. 5 and FIG. 6, the wire bundle of exciting coil 120 is arranged in an arc shape along the outer peripheral surface of retaining roller 113 at the ends of retaining roller 113, and is placed along the bus line direction of that outer peripheral surface in other parts. The wire bundle placed along the bus line direction is located on a virtual cylindrical surface with the rotation axis of retaining roller 113 as its center axis. At the edges of fixing belt 112, exciting coil 120 wire bundles are raised by being stacked in two rows.

Reference number 121 is an excitation core of ferrite as high-permeability material (with relative permeability of 2000, for example). Excitation core 121 is composed of a center core 121*a* located at the circulation center of exciting coil 120 and parallel to the center axis of fixing belt 112, approximately arch-shaped arch cores 121*b* located on the opposite side of exciting coil 120 relative to fixing belt 112, and a pair of front cores 121*c* located at the circulation end part of exciting coil 120 and parallel to the rotation axis of fixing belt 112. As shown in FIG. 6, a plurality of arch cores 121*b* are spaced in the rotation axis direction of fixing belt 112. Center core 121*a* is located inside the aperture of the center part of circulated exciting coil 120. Also, the pair of front cores 121*c* are connected to either end of arch cores 121*b*, and face fixing belt 112 without the intermediation of exciting coil 120. Center core 121*a*, arch cores 121*b*, and front cores 121*c* are magnetically coupled.

Apart from ferrite, a material of high magnetic permeability and high resistivity, such as ferrosilicon sheet, for example, is desirable as the material of excitation core 121. Also, center core 121*a* and front cores 121*c* may be divided into a plurality of parts in the lengthwise direction.

Reference number 122 indicates a coil supporting member of PEEK (polyetheretherketone), PPS, or a similar resin with a high heat-resistant temperature. Exciting coil 120 and excitation core 121 maintain the shape shown in the drawing by being attached to coil supporting member 122.

FIG. 7 shows the basic circuit diagram of a monolithic resonance type inverter used for an excitation circuit 123. An alternating current from a commercial power supply 160 is rectified by a rectifier circuit 161, and applied to a voltage resonance type inverter. In this inverter, a high-frequency current is applied to exciting coil 120 by switching of a switching element 164 such as an IGBT (Insulated Gate Bipolar Transistor) and a resonance capacitor 163. Reference number 162 indicates a diode.

A 30 kHz alternating current with a maximum current amplitude of 60 A and a maximum voltage amplitude of 600 V is applied to exciting coil 120 from excitation circuit 123, a voltage resonance type inverter. Temperature sensor 118 is positioned in the center of the rotation axis direction of fixing belt 112, facing fixing belt 112. The alternating current applied to exciting coil 120 is controlled by a temperature signal from this temperature sensor 118 so that the surface of fixing belt 112 becomes 170 degrees centigrade, which is the fixing set temperature.

In an image forming apparatus that has a fixing unit 19 configured as described above, a toner image is formed on the outer surface of photosensitive drum 11 (see FIG. 4), and after this toner image has been transferred to the surface of recording paper 16, a recorded image is obtained by feeding recording paper 16 into the nip area from the direction indicated by the arrow shown in FIG. 4 and fixing the toner image on recording paper 16.

In this embodiment, above-described exciting coil 120 causes fixing belt 112 to produce heat by means of electromagnetic induction. This operation is described below using FIG. 8.

As shown by the dotted lines in FIG. 8, magnetic flux M generated by exciting coil 120 due to an alternating current from excitation circuit 123 penetrates fixing belt 112 from front cores 121*c* of excitation core 121 and enters opposed core 116 inside retaining roller 113, and passes through the interior of opposed core 116 due to the magnetic properties of opposed core 116. Magnetic flux M then penetrates fixing belt 112 again and enters center core 121*a* of excitation core 121, passes through arch cores 121*b*, and reaches front cores 121*c*. This magnetic flux M goes through its repeated generation and extinction due to the alternating current of excitation circuit 123. An induction current generated by variations of this magnetic flux M flows inside fixing belt 112 and generates Joule heat. Center core 121*a* and front cores 121*c* consecutive in the fixing belt 112 rotation axis direction have an effect of scattering magnetic flux M that has passed through arch cores 121*b* in the rotation axis direction and uniformizing the magnetic flux density.

Next, the operation of opposed core 116 will be described. When the temperature of opposed core 116 is lower than the Curie point across the entire axial-direction width, opposed core 116 has ferromagnetism uniformly in the axial direction, and increases the magnetic permeability of the area through which magnetic flux M passes. As the magnetoresistance of this area falls, magnetic coupling between exciting coil 120 and fixing belt 112 improves. Therefore, fixing belt 112 can be efficiently heated uniformly in the axial direction. Consequently, the high-frequency current and voltage applied to exciting coil 120 can be set low when predetermined power is applied. As a result, inexpensive electronic parts with a low withstand voltage and low current capacity can be used in excitation circuit 123.

On the other hand, when paper narrow in width is fed continuously in this state, while the entire width is heated uniformly recording paper 16 passes through only the center part, absorbing heat, and therefore the temperature of the edges of fixing belt 112, which are paper non-passage areas, rises. As opposed core 116 is facing and close to these fixing belt 112 edges whose temperature rises, the temperature of the ends of opposed core 116 also rises. Consequently, the temperature of the ends of opposed core 116 becomes higher than the Curie point of the constituent material, ferromagnetism is lost, and permeability decreases.

In this state, the magnetic coupling between exciting coil 120 and fixing belt 112 decreases at the edges, and the calorific value declines. A further rise in the temperature of the edges of fixing belt 112 can thus be prevented. As a result, fixing defects such as offset arising when the edge temperature is too high can be prevented even if wide paper is fed through after continuous feeding of narrow paper. At the same time, it is possible to prevent fixing unit 19 and the body of the apparatus from exceeding their respective heat-resistant temperatures and becoming deformed due to an excessive rise in the temperature of fixing unit 19.

When the temperature of the edges of fixing belt 112 returns to a state equivalent to the fixing temperature, the temperature of opposed core 116 also falls to the Curie point or below and opposed core 116 is restored to a ferromagnetic body, and therefore the initial state—that is, a state of a high degree of magnetic coupling—is restored uniformly in the axial direction.

Of course, the center part of fixing belt 112 has its heat absorbed by recording paper 16 and is subjected to temperature control based on a temperature signal from temperature sensor 118, thereby being held constantly at a fixed temperature. Also, when maximum-width recording paper is passed through, the entire width is heated uniformly and heat is absorbed uniformly, so that extreme temperature distribution does not occur.

In this embodiment, the Curie point of opposed core 116 (190° C.) is made higher than the fixing temperature (170° C.), and therefore opposed core 116 acts as a ferromagnetic body except in areas where the temperature of fixing belt 112 becomes too high. Therefore, exciting coil 120 and fixing belt 112 can be magnetically coupled efficiently when there is a rise in the fixing temperature or when wide paper is fed through. The above effect can be obtained when this Curie point is in a range of −10° C. to +100° C. relative to the maximum value of the predetermined fixing temperature. When utilizing toner that uses common styrene acrylonitrile or polyester as a base, the above effect can be obtained when the Curie point is in the range of 140° C. to 250° C.

Actually, according to this embodiment, the Curie point of opposed core 116 is set so as to be higher than the temperature of opposed core 116 in a paper passage area and lower than the temperature of opposed core 116 in a paper non-passage area. Therefore, in a paper passage area, fixing belt 112 can be uniformly heated efficiently by having the magnetic coupling between exciting coil 120 and fixing belt 112 maintained, and in a paper non-passage area, the calorific value can be reduced and overheating of the fixing belt prevented by decreasing the magnetic coupling between exciting coil 120 and fixing belt 112.

Also, by locating high-permeability opposed core 116 within the induction heating magnetic path, leakage of magnetic flux M outside fixing unit 19 can be prevented.

Furthermore, as opposed core 116 has a uniform cross-sectional shape in the axial direction, the calorific value of heat-producing areas in proximity to opposed core 116 is uniform in the axial direction. Therefore, uniform temperature distribution can easily be achieved by heating uniformly with exciting coil 120.

Moreover, by heating fixing belt 112 using a part wrapped around retaining roller 113 as a heat-producing section, the shape of fixing belt 112 is stabilized and a constant distance can easily be maintained between fixing belt 112 and exciting coil 120.

Also, as opposed core 116 is located inside retaining roller 113 that rotates in contact with fixing belt 112, opposed core 116 is not cooled by heat dissipation. Therefore, the temperature of opposed core 116 rises rapidly and with good responsiveness in accordance with a rise in the temperature of fixing belt 112, enabling an excessive temperature rise of fixing belt 112 to be prevented promptly.

As described above, according to this embodiment, it is possible to prevent the temperature of both ends where heat is not absorbed by narrow recording paper 16 from rising excessively, and a component part (such as fixing unit 19, for example) of an image forming apparatus from being heated in excess of its heat-resistant temperature and being damaged or degraded, without using a mechanical configuration for a means of heat production distribution adjustment. Furthermore, the temperature distribution does not vary greatly across the entire width of fixing belt 112 even when maximum-width recording paper is fed through immediately after narrow paper has been fed through continuously, enabling the occurrence of fixing defects such as offset to be prevented even when using wide paper.

With a conventional fixing unit, if the temperature of both ends becomes excessively high when narrow paper is fed through continuously, it is necessary to stop the printing operation and wait until the temperature of both ends falls, or to increase the recording paper feeding interval, but with this embodiment, a rise in the temperature of both ends when narrow paper is fed through can be suppressed, making it unnecessary to wait or increase the paper feeding interval in the event of an excessive rise in temperature. Therefore, throughput (the number of sheets output per unit time) can be set high when outputting narrow paper continuously.

In this embodiment, opposed core 116 is assumed to be cylindrical. However, as long as the distance from fixing belt 112 opposite exciting coil 120 is uniform in the axial direction, the cross-sectional shape of opposed core 116 is not limited to this, and may be semicircular or arc-shaped. If the cross-sectional shape of opposed core 116 is semicircular or arc-shaped, the calorific value of opposed core 116 is less than when opposed core 116 is cylindrical, and therefore the temperature of opposed core 116 changes more quickly in response to a rise in the temperature of fixing belt 112.

In this embodiment, the distance between opposed core 116 and retaining roller 113 is taken to be 0.5 mm, but it is desirable for this distance to be in the range of 0.3 mm to 2 mm. If the distance is less than this, nonuniformity of heat transfer distribution may occur in the axial direction due to partial contact of retaining roller 113 and opposed core 116. As a result, nonuniformity of temperature distribution may occur despite uniform heating, preventing a uniform fixed image from being obtained. On the other hand, if this distance exceeds the above range, thermal conductivity from fixing belt 112 and retaining roller 113 to opposed core 116 will degrade, and the responsiveness of a temperature rise of opposed core 116 when the temperature of fixing belt 112 rises will be poor. In practice, this distance may be 2 mm or less.

Also, it is desirable for the distance between opposed core 116 and fixing belt 112 to be 2 mm or less. If this distance exceeds 2 mm, the magnetic coupling between exciting coil 120 and fixing belt 112 will be poor, and it may not be possible to perform induction heating efficiently.

In this embodiment, the mutually facing surfaces of opposed core 116 and retaining roller 113 are both black, facilitating the emission and absorption of infrared rays between opposed core 116 and retaining roller 113. This facilitates the transfer of heat between the two. This is practicable if at least one of the opposing surfaces has infrared emissivity of 0.8 to 1.0, and it is desirable for the infrared emissivity of both opposing surfaces to be 0.8 or above. As infrared ray emissivity and absorptivity are the same numeric value, setting emissivity high means simultaneously setting absorptivity high.

In this embodiment, opposed core 116 is fixed, but it may also be configured so as to rotate integrally with retaining roller 113.

Figure 9:
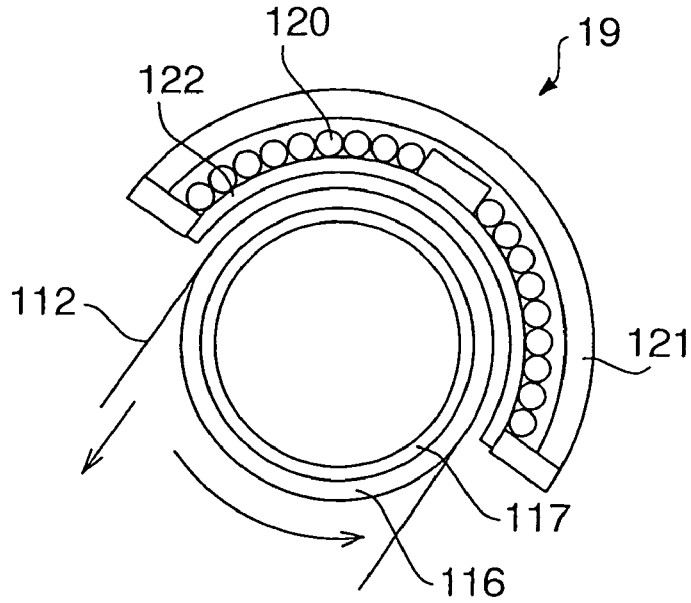
FIG. 9 is a cross-sectional drawing showing a first different sample configuration of a fixing unit according to Embodiment 1 of the present invention.

Also, the configuration of the heat-producing part is not limited to the separate installation of retaining roller 113 and opposed core 116 as described above. For example, the same kind of effect can also be achieved with a configuration in which opposed core 116 has a roller shape and rotates itself suspending fixing belt 112 directly, as shown in FIG. 9. In this case it is not necessary to provide retaining roller 113, simplifying the configuration. Also, since heat is transferred directly from fixing belt 112 to opposed core 116, the temperature of opposed core 116 changes more quickly in response to a rise in the temperature of fixing belt 112.

Figure 10:
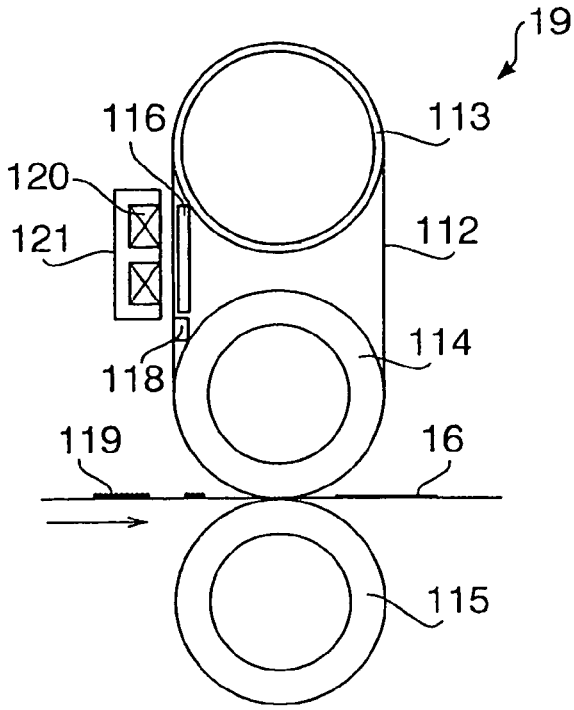
FIG. 10 is a cross-sectional drawing showing a second different sample configuration of a fixing unit according to Embodiment 1 of the present invention.

Furthermore, with regard to the configuration of the heat-producing part, exciting coil 120 and opposed core 116 may be installed so as to sandwich fixing belt 112 stretched over retaining roller 113 and fixing roller 114, as shown in FIG. 10.

Figure 11:
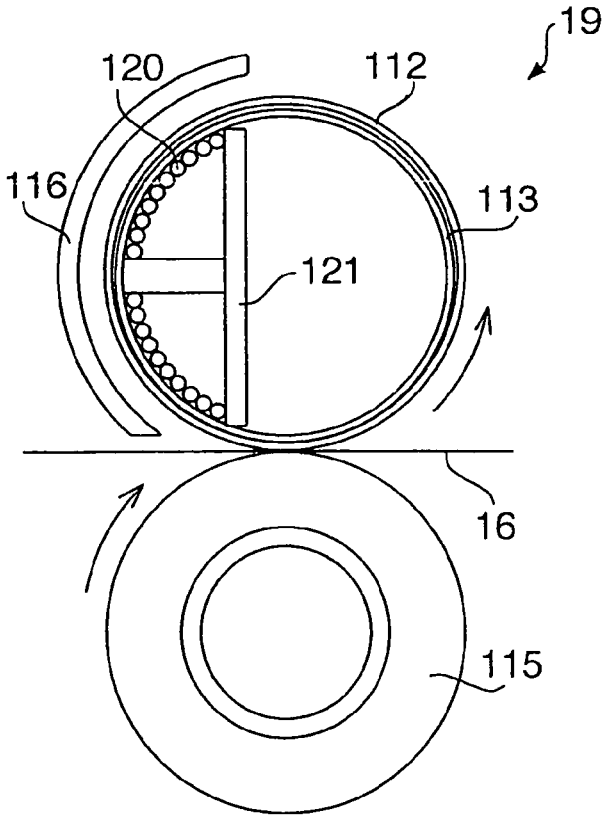
FIG. 11 is a cross-sectional drawing showing a third different sample configuration of a fixing unit according to Embodiment 1 of the present invention.

Moreover, the configuration of fixing unit 19 is not limited to having fixing belt 112 as described above suspended on two rollers (retaining roller 113 and fixing roller 114) and having exciting coil 120 facing the outer peripheral surface of fixing belt 112. For example, a configuration may also be implemented in which exciting coil 120 is provided inside retaining roller 113, retaining roller 113 is pressed against pressure roller 115 via fixing belt 112, and an approximately arc-shaped opposed core 116 is facing and close to the outer peripheral surface of fixing belt 112, as shown in FIG. 11.

A configuration may also be implemented in which a fixing belt 112 of the same diameter encloses the outer periphery of retaining roller 113, and retaining roller 113 is pressed against pressure roller 115 via fixing belt 112. With this configuration, it is not necessary to provide fixing roller 114 and retaining roller 113 separately, and a mechanism providing tension to fixing belt 112 is also unnecessary, enabling the configuration to be simplified and manufacturing costs to be reduced. In addition, the peripheral length of fixing belt 112 is shortened, reducing the thermal capacity for a rise in temperature, and thus decreasing the energy necessary for a temperature rise and at the same time enabling the temperature rise time to be shortened.

Embodiment 2

Figure 13:
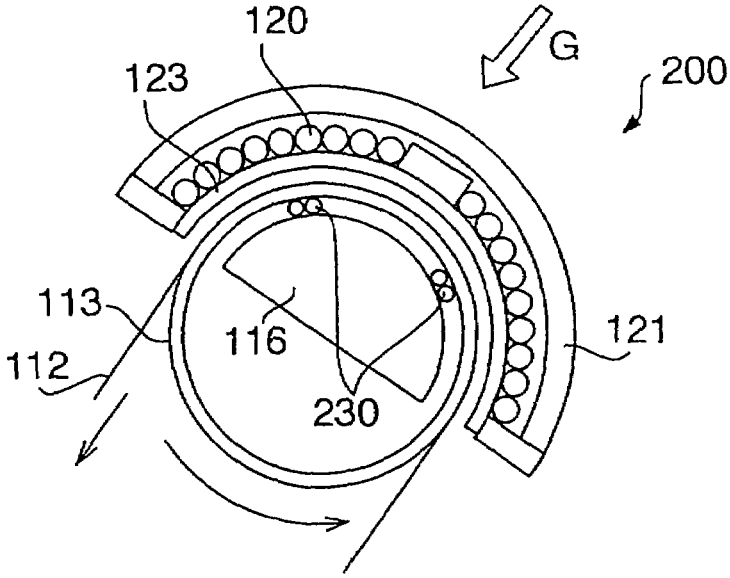
FIG. 13 is a cross-sectional drawing of the principal parts of a fixing unit according to Embodiment 2 of the present invention.
Figure 14:
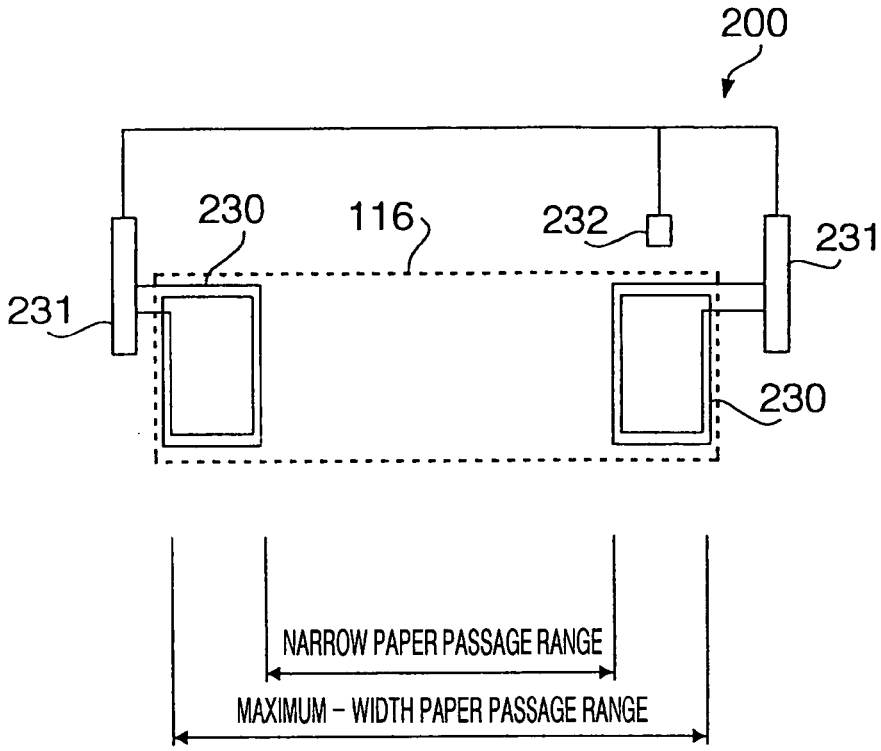
FIG. 14 is a principal-part configuration drawing of a magnetic flux adjustment section viewed from the direction indicated by arrow G in FIG. 13.

FIG. 13 is a cross-sectional drawing of the principal parts of a fixing unit according to Embodiment 2 of the present invention, and FIG. 14 is a principal-part configuration drawing of opposed core 116 constituting a magnetic flux adjustment section viewed from the direction indicated by arrow G in FIG. 13.

This embodiment differs from Embodiment 1 in the configuration of the magnetic flux adjustment section. That is to say, in this embodiment, at either end of opposed core 116, a 2-turn short coil (hereinafter referred to as "suppression coil") 230 of litz wire is provided in the part facing exciting coil 120. Also provided are relays 231 serving as switching sections that perform electrical on/off switching of either end of opposed core 116. Relays 231 have a switching element such as a power transistor and a contact. The cross-sectional shape of opposed core 116 is uniformly semicircular in the axial direction. Opposed core 116 is supported fixedly and not rotated. A temperature sensor 232 is provided that measures the temperature of fixing belt 112 outside the narrow paper passage range and within the maximum-width paper passage range, and relays 231 are opened and closed based on a temperature signal from temperature sensor 232.

Other details are similar to Embodiment 1, and configuration elements in this embodiment that have the same action as in Embodiment 1 are assigned the same reference codes as in Embodiment 1, and detailed descriptions thereof are omitted.

If the temperature measured by temperature sensor 232 is lower than a first predetermined temperature (for example, 180° C.) that is higher than the fixing temperature (for example, 170° C.), each relay 231 is placed in the open state. In this state, current does not flow in suppression coil 230, and therefore fixing belt 112 is heated with uniform heat production distribution by exciting coil 120.

On the other hand, if the temperature measured by temperature sensor 232 is higher than 180° C. due to continuous passage of narrow paper, each relay 231 is placed in the conducting state. In this state, an induction current flows in the direction in which it cancels out variations in magnetic flux linked to suppression coil 230. Therefore, magnetic flux can no longer pass through the interior of suppression coil 230. Consequently, magnetic flux from exciting coil 120 acting upon fixing belt 112 in the area in which suppression coil 230 is located decreases. As a result, heat production distribution of narrow paper non-passage areas declines, and an excessive rise in the temperature of the paper non-passage areas can be prevented.

Then, when the temperature measured by temperature sensor 232 becomes a second predetermined temperature (for example, 160° C.) that is lower than the fixing temperature, relays 231 are placed in the open state and uniform heat production distribution is restored.

As an opposed core 116 on the opposite side of suppression coil 230 from fixing belt 112 is used, the magnetic coupling of exciting coil 120, fixing belt 112, and suppression coil 230 improves, enabling the temperature distribution adjustment action of suppression coil 230 by means of the opening and closing of relay 231 to be made sufficiently great. By locating part of opposed core 116 inside suppression coil 230, the temperature distribution adjustment action of suppression coil 230 by means of the opening and closing of relay 231 can be further increased.

As described above, according to this embodiment, the temperature distribution of fixing belt 112 can be kept constantly substantially uniform even when narrow paper is continuously fed through without providing a mechanical contrivance. Therefore, fixing defects such as cold offset or hot offset due to nonuniformity of fixing temperature distribution can be prevented when wide paper is fed through immediately after narrow paper is fed through, or when narrow paper and wide paper are fed through alternately. That is to say, if the entire width of fixing belt 112 is heated during warm-up, it is possible to feed through both narrow paper and wide paper immediately. On the other hand, if only the narrow paper passage range, for example, is heated during warm-up, in the event of an abnormality such as non-rotation of fixing belt 112, the surface temperature of fixing belt 112 will rise steeply and a safety mechanism (such as a thermostat, for example) may not be able to follow. If full-width heating is performed during warm-up, the temperature rise time of fixing belt 112 can be extended, and the follow-up operation of the safety mechanism can be assured.

Although it is also possible for suppression coil 230 to be located inside or close to exciting coil 120, in this embodiment suppression coil 230 is located on the opposite side of fixing belt 112 from exciting coil 120. By this means, the current and voltage induced in suppression coil 230 are low, and a rise in the temperature of suppression coil 230 is suppressed. As a result, inexpensive material with a low withstand voltage and heat-resistant temperature can be used for the wire insulating coating. Also, inexpensive items with a low withstand voltage and current capacity can be used for relays 231 that open and close suppression coils 230. Furthermore, electromagnetic noise generated during relay 231 opening and closing operations can be suppressed.

An opposed core 116 located on the opposite side of suppression coil 230 relative to fixing belt 112 is used, but a configuration in which no opposed core 116 is provided can also be implemented. In this case, the use of an expensive and heavy material such as ferrite is not necessary, enabling the apparatus to be made less expensive and lighter.

Suppression coil 230 is not limited to an above-described wire material wound around a plurality of times. For example, the same kind of effect can be obtained with a configuration in which a thin metal sheet is formed with a single loop. This configuration does not require multiple windings of wire, enabling the manufacturing process to be simplified.

It is not absolutely necessary for the installation range of suppression coil 230 to provide for the width of narrow paper fed through. For example, setting may be performed in a range greater than the width of narrow paper and less than the maximum paper width, taking into consideration the amount of heat lost by heat transfer from both ends via the bearings.

Suppression coil 230 may have any configuration, as long as its loop formation direction is linked to magnetic flux from exciting coil 120.

Embodiment 3

Figure 15:
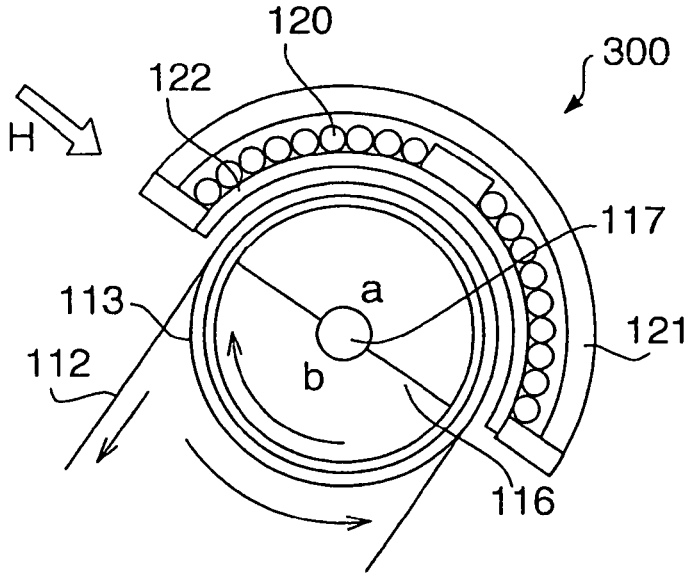
FIG. 15 is a cross-sectional drawing of the principal parts of a fixing unit according to Embodiment 3 of the present invention.
Figure 16:
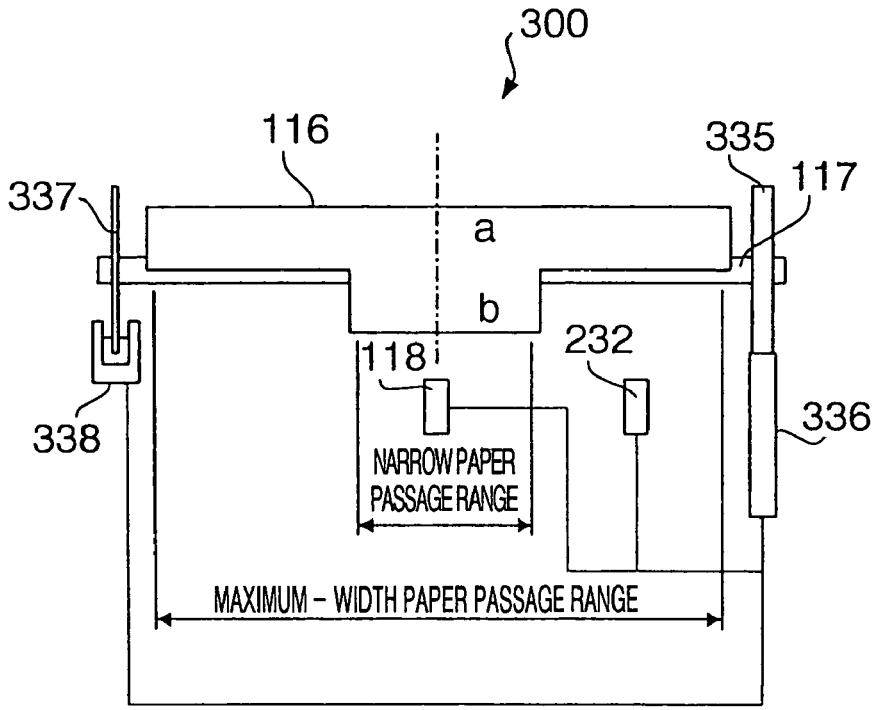
FIG. 16 is an arrow-view drawing of a magnetic flux adjustment section viewed from the direction indicated by arrow H in FIG. 15.

FIG. 15 is a cross-sectional drawing of the principal parts of a fixing unit according to Embodiment 3 of the present invention, and FIG. 16 is a principal-part configuration drawing of opposed core 116 constituting a magnetic flux adjustment section viewed from the direction indicated by arrow H in FIG. 15.

This embodiment differs from Embodiment 2 in the configuration of the magnetic flux adjustment section. That is to say, in this embodiment, suppression coil 230 is not provided, and the cross-sectional shape of a part of cylindrical opposed core 116 corresponding to a narrow paper non-passage area is varied in the axial direction. Also, a gear 335 is fitted to the right-hand end of opposed core 116 in FIG. 16. A rotation section 336 rotates this gear 335, and opposed core 116 rotates in accordance with this rotation. A disk 337 that has a notch is fitted to the other end (in FIG. 16, the left-hand end) of opposed core 116. A photosensor 338 is provided to detect the rotation of this notch. Rotation section 336 (in other words, the rotation of opposed core 116) is controlled based on a temperature signal from temperature sensor 232 that measures the temperature of fixing belt 112 outside the narrow paper passage range and within the maximum-width paper passage range.

Other details are similar to Embodiment 2, and configuration elements in this embodiment that have the same action as in Embodiment 2 are assigned the same reference codes as in Embodiment 2, and detailed descriptions thereof are omitted.

Opposed core 116 has a semicircular shape at both axial-direction ends (outside the narrow paper passage range), and a circular shape in the axial-direction center part (within the narrow paper passage range). The phases of the semicircular shapes at both ends coincide with respect to the rotation axis, and the semicircular shapes are uniform in the axial direction. Hereinafter, in this embodiment, opposed core 116 that has this kind of shape is regarded as a combination of two semicylinders, one of which is called part a, and the other one part b. Part a is a semicylinder that has substantially the same width as the maximum-width paper passage range, and part b is a semicylinder that has substantially the same width as the narrow paper passage range. Rotation section 336 has a stepping motor. Rotation section 336 detects the origin of posture of opposed core 116 by means of a photosensor 338 signal, and sets the angle of rotation from this origin of posture as a number of stepping motor drive pulses. There is no need to use an expensive detection apparatus such as an expensive, high-resolution encoder for opposed core 116, making the configuration simple and inexpensive.

The operation and action of opposed core 116 as a magnetic flux adjustment section in this embodiment will now be described.

If the temperature measured by end temperature sensor 232 is lower than a first predetermined temperature (for example, 180° C.) that is higher than the fixing temperature (for example, 170° C.), part a of opposed core 116 is positioned to face exciting coil 120. When current is passed through exciting coil 120 in this state, magnetic flux acts uniformly upon the entire axial-direction width of fixing belt 112, and induction heating is performed uniformly. When recording paper 16 fed through is wide, heat is absorbed over substantially the entire width, and therefore the temperature of fixing belt 112 is maintained uniformly over its entire width.

When narrow recording paper 16 is passed through, heat of only the center part is absorbed by the recording paper, and together with this, temperature control is performed based on a temperature signal from temperature sensor 118 in proximity to the center part. Therefore, the temperature of both end parts, which are paper non-passage areas, rises. When the temperature measured by temperature sensor 232 exceeds 180° C., opposed core 116 is rotated and part b is positioned to face exciting coil 120. In this state, the distance between a part of fixing belt 112 corresponding to a paper non-passage area and opposed core 116 becomes greater than the distance from the part corresponding to the center paper passage area. Consequently, the magnetic coupling between fixing belt 112 and exciting coil 120 in the paper non-passage areas becomes poorer than for the paper passage area, and magnetic flux from exciting coil 120 acting on fixing belt 112 in the paper non-passage areas decreases. As a result, heat production distribution of the narrow paper non-passage areas declines, and an excessive rise in the temperature of the paper non-passage areas can be prevented.

Then, when the temperature measured by temperature sensor 232 becomes a second predetermined temperature (for example, 160° C.) that is lower than the fixing temperature, part a of opposed core 116 is positioned to face exciting coil 120 and uniform heat production distribution is restored.

As described above, according to this embodiment, the temperature distribution of fixing belt 112 can be kept constantly substantially uniform even when narrow paper is continuously fed through. Therefore, fixing defects such as cold offset or hot offset due to nonuniformity of fixing temperature distribution can be prevented when wide paper is fed through immediately after narrow paper is fed through, or when narrow paper and wide paper are fed through alternately. That is to say, if the entire width of fixing belt 112 is heated during warm-up, it is possible to feed through both narrow paper and wide paper immediately. On the other hand, if only the narrow paper passage range, for example, is heated during warm-up, in the event of an abnormality such as non-rotation of fixing belt 112, the surface temperature of fixing belt 112 will rise steeply and a safety mechanism (such as a thermostat, for example) may not be able to follow. If full-width heating is performed during warm-up, the temperature rise time of fixing belt 112 can be extended, and the follow-up operation of the safety mechanism can be assured.

With a conventional fixing unit, if the temperature of both ends becomes excessively high when narrow paper is fed through continuously, it is necessary to stop the printing operation and wait until the temperature of both ends falls, or to increase the recording paper feeding interval. With this embodiment, on the other hand, a rise in the temperature of both ends when narrow paper is fed through can be suppressed, making it unnecessary to wait or increase the paper feeding interval in the event of an excessive rise in temperature. Therefore, throughput (the number of sheets output per unit time) can be set high when outputting narrow paper continuously.

As opposed core 116 is rotated as an integral unit, the mechanism for rotational drive is simple. In the case of a configuration in which the center part of the opposed core is fixed, a complex mechanism is necessary in order to rotate only the end parts. Also, as opposed core 116 is rotated inside retaining roller 113, the heat-producing section can be made small.

In this embodiment, opposed core 116 is rotated (reversed) by 180 degrees in order to adjust the heat production distribution of the ends. However, this angle of rotation is not limited to 180 degrees. For example, the angle of rotation may be adjusted in accordance with temperature variations of paper non-passage areas. With this configuration, the heat production distribution of paper non-passage areas can be controlled precisely, and the temperature distribution of fixing belt 112 can be made uniform.

Figure 17:
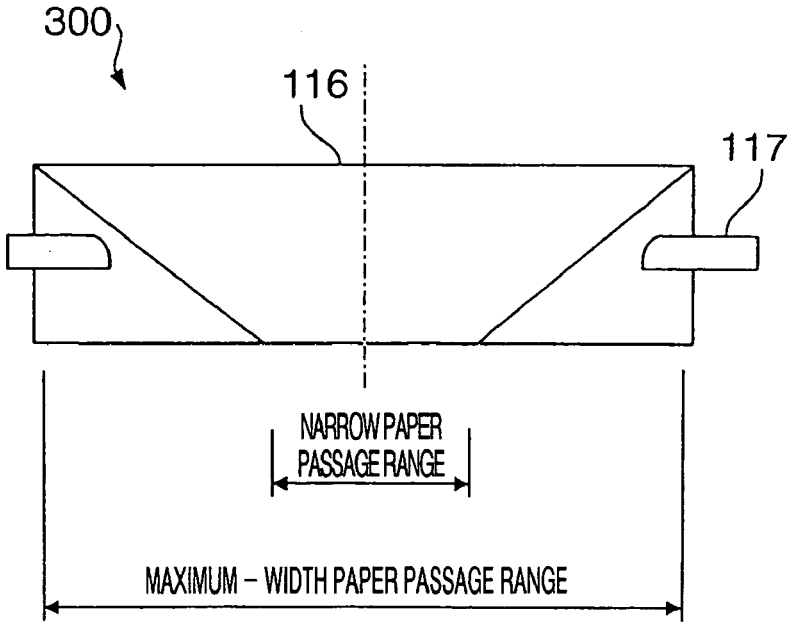
FIG. 17 is a principal-part configuration drawing of a sample modification of a magnetic flux adjustment section according to Embodiment 3 of the present invention.

In this embodiment, the cross-sectional shape of the ends of opposed core 116 is uniform in the axial direction. However, the cross-sectional shape of opposed core 116 may be varied continuously in the range corresponding to narrow paper non-passage areas, as shown in FIG. 17. With this configuration, opposed core 116 has a semicircular cross-section only at the ends, and its cross-sectional shape varies continuously until becoming a circular cross-section in the area corresponding to the narrow paper passage range. That is to say, with this opposed core 116, the distance from fixing belt 112 is greater the nearer the ranges in which the surface recedes from the fixed cylindrical surface in the rotation center direction are to axial-direction end parts, and one of these receding ranges starts from the same bus-line in the circumferential direction.

When the above configuration is used, by varying the rotational phase of opposed core 116 it is possible to vary continuously and arbitrarily the length of the part where opposed core 116 is facing exciting coil 120 at the same distance as the center part. By this means, the width of areas with low heat production distribution at both ends can be set continuously and arbitrarily. As a result, the above-described effect can be obtained for any width of recording paper 16 fed through.

Figure 18:
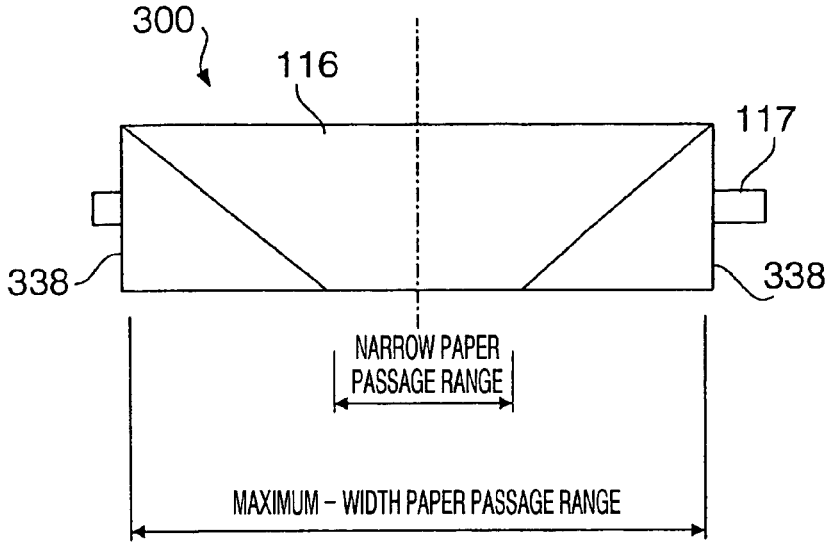
FIG. 18 is a principal-part configuration drawing of another sample modification of a magnetic flux adjustment section according to Embodiment 3 of the present invention.

In this embodiment, a member is not specially provided in the concavity from the cylindrical shape of opposed core 116, but an adjustment member 338 of different permeability from that of opposed core 116 may be provided in this part, as shown in FIG. 18.

If a magnetic material of lower permeability than opposed core 116 (such as ferrite resin with a permeability of 10, for example) is used for adjustment member 338, the difference in peak intensity of the calorific value can be adjusted arbitrarily in accordance with the permeabilities of opposed core 116 and adjustment member 338.

Also, if a nonmagnetic conductive material such as aluminum or copper is used for adjustment member 338, the difference in peak intensity of the calorific value can be further increased. This is because conductive material has a property of being susceptible to the flow of an eddy current in an induced magnetic field and scarcely allowing the passage of induced magnetic flux inside. Furthermore, as opposed core 116 has a uniform cross-sectional shape in the axial direction, thermal capacity distribution of the heat-producing section approaches uniformity in the axial direction. Therefore, uniform temperature distribution can easily be achieved by performing heating uniformly by means of exciting coil 120.

Instead of varying the cross-sectional shape of opposed core 116 continuously from the center part toward the ends, the cross-sectional shape may be varied stepwise taking the recording paper widths used into consideration. According to this configuration, recording paper of a plurality of widths can be provided for, and the difference in calorific values at the boundary of a heated part and unheated part (strong and weak heat production distribution areas) can be made prominent.

Embodiment 4

Figure 19A:
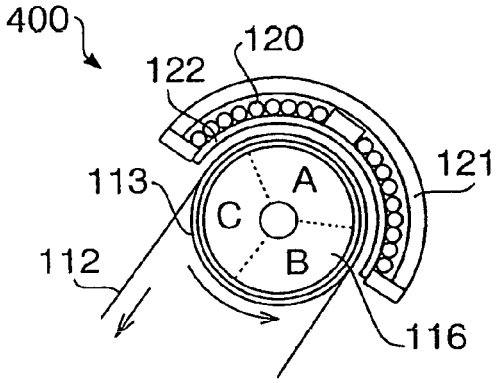
FIG. 19A is a cross-sectional drawing of the principal parts of a fixing unit according to Embodiment 4 of the present invention, showing a case where magnetic flux acts upon the entire width of the fixing belt.
Figure 19B:
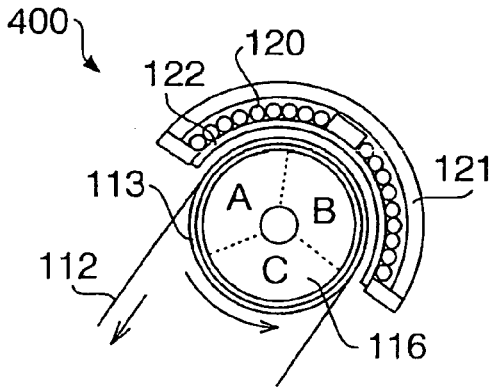
FIG. 19B is a cross-sectional drawing of the principal parts of a fixing unit according to Embodiment 4 of the present invention, showing a case where magnetic flux acting upon other than a narrow paper passage range of the fixing belt is decreased.
Figure 19C:
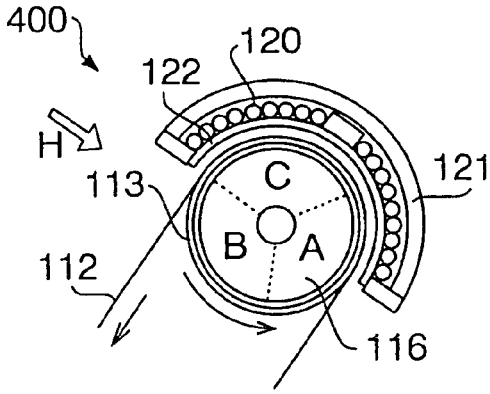
FIG. 19C is a cross-sectional drawing of the principal parts of a fixing unit according to Embodiment 4 of the present invention, showing a case where magnetic flux acting upon a narrow paper passage range of the fixing belt is decreased.
Figure 20:
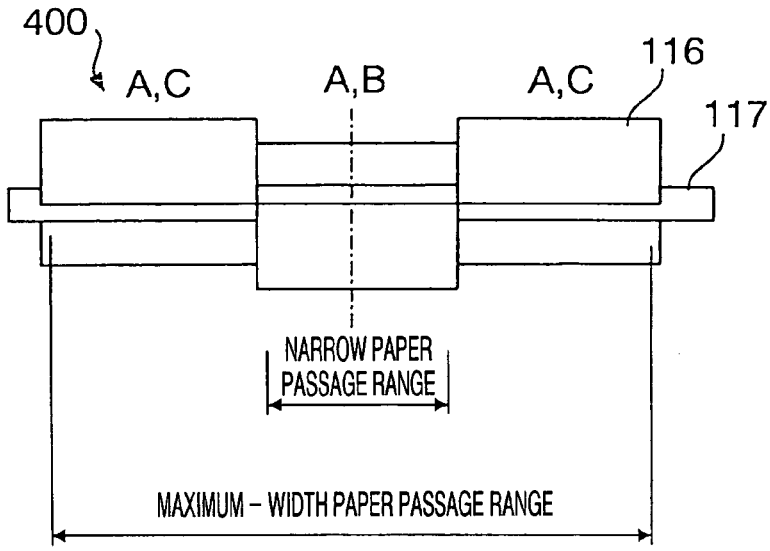
FIG. 20 is a principal-part configuration drawing of a magnetic flux adjustment section viewed from the direction indicated by arrow H in FIG. 19C.

FIG. 19A, FIG. 19B, and FIG. 19C are cross-sectional drawings of the principal parts of a fixing unit according to Embodiment 4 of the present invention, and FIG. 20 is a principal-part configuration drawing of opposed core 116 constituting a magnetic flux adjustment section viewed from the direction indicated by arrow H in FIG. 19C.

This embodiment differs from Embodiment 3 in the configuration of the magnetic flux adjustment section. That is to say, in this embodiment, opposed core 116 has three areas: A, B, and C. Areas A, B, and C are defined by dividing opposed core 116 into three equal parts with three planes extending outward from spindle 117 as boundaries. The shape of opposed core 116 is different in each of areas A, B, and C. In area A, opposed core 116 spans the full width of the axial direction. In area B, opposed core 116 spans only a range corresponding to the center narrow paper passage area (narrow paper passage range). In area C, opposed core 116 spans only ranges corresponding to the narrow paper non-passage areas at both ends (excluding the narrow paper passage range).

Other details are similar to Embodiment 3, and configuration elements in this embodiment that have the same action as in Embodiment 3 are assigned the same reference codes as in Embodiment 3, and detailed descriptions thereof are omitted.

The operation and action of opposed core 116 as a magnetic flux adjustment section in this embodiment will now be described using FIG. 19A, FIG. 19B, and FIG. 19C.

If the temperature difference between center temperature sensor 118 and end temperature sensor 232 is less than a predetermined temperature difference (for example, 15° C.), and the temperature measured by temperature sensor 232 is lower than a first predetermined temperature (for example, 180° C.) that is higher than the fixing temperature (for example, 170° C.), area A of opposed core 116 is positioned to face exciting coil 120 as shown in FIG. 19A. When parts of areas B and C are also facing exciting coil 120, the facing ranges of areas B and C are made the same. When current is passed through exciting coil 120 in this state, magnetic flux acts uniformly upon the entire axial-direction width of fixing belt 112, and induction heating is performed uniformly. When recording paper 16 fed through is wide, heat is absorbed over substantially the entire width, and therefore the temperature of fixing belt 112 is maintained uniformly over its entire width.

When narrow recording paper 16 is passed through, in the state shown in FIG. 19A, heat of only the center part is absorbed by recording paper 16, and together with this, temperature control is performed based on a temperature signal from temperature sensor 118 in proximity to the center part. Therefore, the temperature of both end parts, which are paper non-passage areas, rises. When the temperature measured by temperature sensor 232 exceeds 180° C., opposed core 116 is rotated and area B and part of area A are positioned to face exciting coil 120 as shown in FIG. 19B. In the state in which mainly area B is facing exciting coil 120, the distance between a part of fixing belt 112 corresponding to a paper non-passage area and opposed core 116 becomes greater than the distance from the part corresponding to the center paper passage area. Consequently, the magnetic coupling between fixing belt 112 and exciting coil 120 in the paper non-passage areas becomes poorer than for the paper passage area, and magnetic flux from exciting coil 120 acting upon fixing belt 112 in the paper non-passage areas decreases. As a result, heat production distribution of the narrow paper non-passage areas declines, and an excessive rise in the temperature of the paper non-passage areas can be prevented.

Then, when the temperature measured by temperature sensor 232 becomes a second predetermined temperature (for example, 160° C.) that is lower than the fixing temperature, area A is positioned to face exciting coil 120 as shown in FIG. 19A, and uniform heat production distribution is restored.

If a printing operation is performed with narrow paper when fixing unit 19 is cold (for example, at room temperature), heating is started in the state shown in FIG. 19B in order to heat only the center part. In this case, since only the center part is heated, the thermal capacity for heat production decreases. Therefore, the temperature can be raised to the predetermined temperature (170° C.) with a small amount of energy, and if heating is performed with the same power, the temperature can be raised in a short time.

In this case, the temperature of fixing belt 112 in the paper non-passage areas does not rise to the fixing temperature, and it is therefore possible to prevent the temperature of pressure roller 115 in the paper non-passage areas from becoming excessively higher than in the paper passage area.

Furthermore, in this case a state is established in which the temperature of center temperature sensor 118 is higher than that of end temperature sensor 232. If wide paper is next to be fed through in this state, it is necessary to heat only both end parts. In this case, area C and part of area A are positioned to face exciting coil 120 as shown in FIG. 19C. In the heat production distribution in this state, the calorific value of the center part is small, and the calorific value of the end parts is large. By this means it is possible to change from a state in which the temperature of the end parts is low to a state of uniform temperature distribution. At this time, the temperature of the paper non-passage areas of pressure roller 115 has not risen excessively, and therefore, even when wide paper is fed through, it is possible to prevent irregularities such as uneven glossiness of a fixed image caused by nonuniformity of the temperature of pressure roller 115, enabling high-quality images to be obtained.

The state illustrated in FIG. 19C can be employed when the temperature of center temperature sensor 118 shows at least a predetermined temperature difference (for example, 15° C.) from that of end temperature sensor 232.

As described above, according to this embodiment, the temperature distribution of fixing belt 112 can be kept constantly substantially uniform even when narrow paper is continuously fed through. Therefore, fixing defects such as cold offset or hot offset due to nonuniformity of fixing temperature distribution can be prevented when wide paper is fed through immediately after narrow paper is fed through, or when narrow paper and wide paper are fed through alternately. That is to say, if the entire width of fixing belt 112 is heated during warm-up, it is possible to feed through both narrow paper and wide paper immediately. On the other hand, if only the narrow paper passage range, for example, is heated during warm-up, in the event of an abnormality such as non-rotation of fixing belt 112, the surface temperature of fixing belt 112 will rise steeply and a safety mechanism (such as a thermostat, for example) may not be able to follow. If full-width heating is performed during warm-up, the temperature rise time of fixing belt 112 can be extended, and the follow-up operation of the safety mechanism can be assured.

Also, when starting up for narrow paper printing, it is possible to heat only the center part, enabling the temperature to be raised with a small amount of energy, and also enabling the temperature to be raised in a short time if heating is performed with the same power. Furthermore, uniform temperature distribution can be restored even when the temperature of the end parts has become too low relative to that of the center part through heat dissipation to the end parts or the like.

Moreover, as opposed core 116 is rotated as an integral unit, the mechanism for rotational drive is simple.

Embodiment 5

Figure 21A:
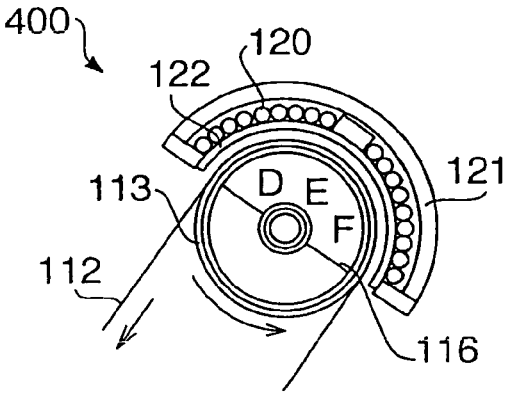
FIG. 21A is a cross-sectional drawing of the principal parts of a fixing unit according to Embodiment 5 of the present invention, showing a case where magnetic flux acts upon the entire width of the fixing belt.
Figure 21B:
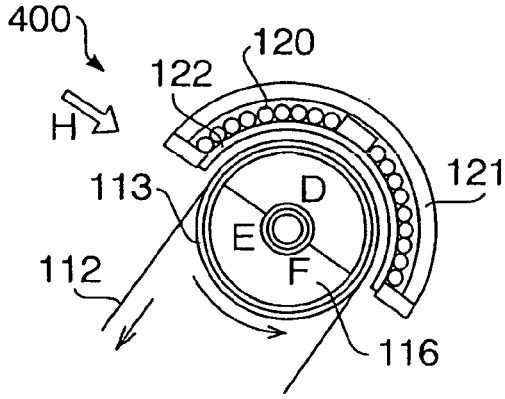
FIG. 21B is a cross-sectional drawing of the principal parts of a fixing unit according to Embodiment 5 of the present invention, showing a case where magnetic flux acting upon other than a narrow paper passage range of the fixing belt is decreased.
Figure 21C:
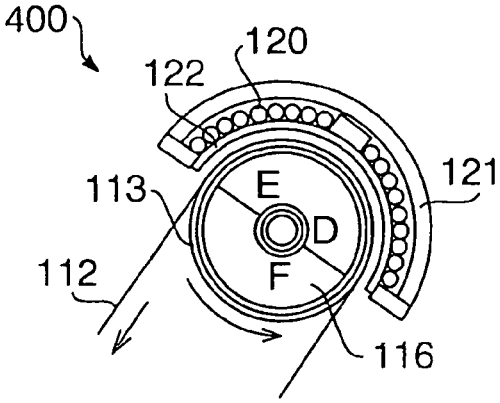
FIG. 21C is a cross-sectional drawing of the principal parts of a fixing unit according to Embodiment 5 of the present invention, showing a case where magnetic flux acting upon other than a medium-width paper passage range of the fixing belt is decreased.
Figure 22:
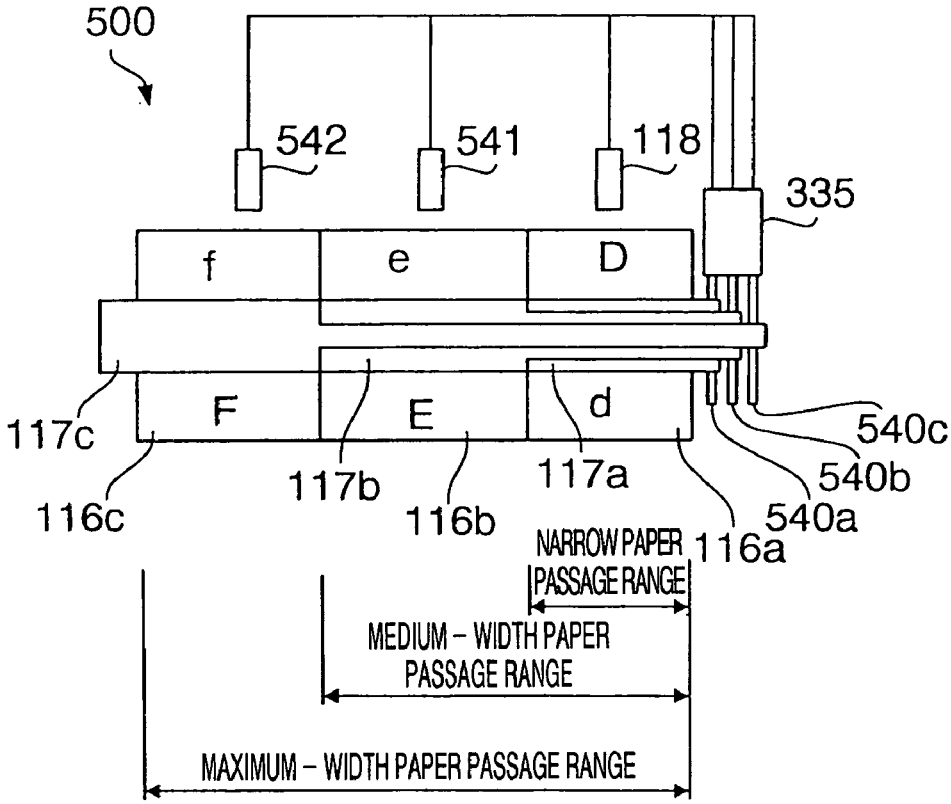
FIG. 22 is a principal-part configuration drawing of a magnetic flux adjustment section viewed from the direction indicated by arrow H in FIG. 21B.

FIG. 21A, FIG. 21B, and FIG. 21C are cross-sectional drawings of the principal parts of a fixing unit according to Embodiment 5 of the present invention, and FIG. 22 is a principal-part configuration drawing of opposed core 116 constituting a magnetic flux adjustment section viewed from the direction indicated by arrow H in FIG. 21B.

This embodiment differs from Embodiment 3 in the configuration of the magnetic flux adjustment section. That is to say, in this embodiment, opposed core 116 is composed of three opposed cores: 116*a*, 116*b*, and 116*c*. Opposed cores 116*a*, 116*b*, and 116*c* are defined by dividing the entire axial-direction width of opposed core 116 into three equal parts. The width of opposed core 116*a* corresponds to the narrow paper passage range, the width of opposed core 116*b* corresponds to the medium-width paper passage range excluding the narrow paper passage range, and the width of opposed core 116*c* corresponds to the maximum-width paper passage range excluding the medium-width paper passage range. Spindle 117 of opposed core 116 is divided equally into three spindles, 117*a*, 117*b*, and 117*c*, corresponding to opposed cores 116*a*, 116*b*, and 116*c* respectively, and opposed cores 116*a*, 116*b*, and 116*c* are fixed to spindles 117*a*, 117*b*, and 117*c* respectively. Gears 540*a*, 540*b*, and 540*c* that rotate spindles 117*a*, 117*b*, and 117*c* respectively are also provided.

Opposed core 116*a* is a combination of a part D and part d that each have a semicylindrical shape. Part D and part d are made of ferrite with different permeabilities, with part D having a higher permeability than part d. Similarly, opposed core 116*b* is a combination of a part E and part e that each have a semicylindrical shape. Part E and part e are made of ferrite with different permeabilities, with part E having a higher permeability than part e. Similarly, opposed core 116*c* is a combination of a part F and part f that each have a semicylindrical shape. Part F and part f are made of ferrite with different permeabilities, with part F having a higher permeability than part f.

Also, in this embodiment, the recording paper 16 paper passage reference position is the right-hand edge in FIG. 22, so that when narrow recording paper 16 is fed through the left-hand side is a paper non-passage area. Furthermore, temperature sensor 118 for temperature control is installed in the narrow paper passage range, a temperature sensor 541 is installed in the medium-width paper passage range outside the narrow paper passage range, and a temperature sensor 542 is installed in the maximum-width paper passage range outside the medium-width paper passage range.

Other details are similar to Embodiment 3, and configuration elements in this embodiment that have the same action as in Embodiment 3 are assigned the same reference codes as in Embodiment 3, and detailed descriptions thereof are omitted.

The operation and action of opposed core 116 as a magnetic flux adjustment section in this embodiment will now be described using FIG. 21A, FIG. 21B, and FIG. 21C.

If the temperature difference between temperature sensor 118 and temperature sensors 541 and 542 is less than a predetermined temperature difference (for example, 15° C.), and the temperature measured by temperature sensors 541 and 542 is lower than a first predetermined temperature (for example, 180° C.) that is higher than the fixing temperature (for example, 170° C.), part D, part E, and part F of opposed core 116 are positioned to face exciting coil 120 as shown in FIG. 21A. When current is passed through exciting coil 120 in this state, magnetic flux acts uniformly upon the entire axial-direction width of fixing belt 112, and induction heating is performed uniformly. When recording paper 16 fed through is wide, heat is absorbed over substantially the entire width, and therefore the temperature of fixing belt 112 is maintained uniformly over its entire width.

When narrow paper is passed through in the state shown in FIG. 21A, heat of only the right-hand end part (the narrow paper passage range) is absorbed by the recording paper, and together with this, temperature control is performed based on a temperature signal from narrow paper passage range temperature sensor 118. Therefore, the temperature of the paper non-passage area (the range comprising the maximum-width paper passage range minus the narrow paper passage range) rises. When the temperature measured by temperature sensors 541 and 542 exceeds 180° C., opposed cores 116*b* and 116*c* are rotated through 180 degrees and part D, part e, and part f are positioned to face exciting coil 120 as shown in FIG. 21B. As the permeability of part e and part f is lower than that of part D, the magnetic coupling between fixing belt 112 and exciting coil 120 in the paper non-passage area becomes poorer than for the paper passage area, and magnetic flux from exciting coil 120 acting upon fixing belt 112 in the paper non-passage area decreases. As a result, heat production distribution of the narrow paper non-passage area declines, and an excessive rise in the temperature of the paper non-passage area can be prevented.

Then, when the temperature measured by temperature sensors 541 and 542 becomes a second predetermined temperature (for example, 160° C.) that is lower than the fixing temperature, part D, part E, and part F are positioned to face exciting coil 120 as shown in FIG. 21A, and uniform heat production distribution is thereby restored.

When medium-width paper is passed through in the state shown in FIG. 21A, heat of only that paper passage area is absorbed by the recording paper, and together with this, temperature control is performed based on a temperature signal from temperature sensor 118. Therefore, the temperature of the paper non-passage area (the range comprising the maximum-width paper passage range minus the medium-width paper passage range) rises. When the temperature measured by temperature sensor 542 exceeds 180° C., opposed core 116*c* is rotated through 180 degrees and part D, part E, and part f are positioned to face exciting coil 120 as shown in FIG. 21C. As the permeability of part f is lower than that of part D and part E, the magnetic coupling between fixing belt 112 and exciting coil 120 in the paper non-passage area becomes poorer than for the paper passage area, and magnetic flux from exciting coil 120 acting upon fixing belt 112 in the paper non-passage area decreases. As a result, heat production distribution of the medium-width paper non-passage area declines, and an excessive rise in the temperature of the paper non-passage area can be prevented.

Then, when the temperature measured by temperature sensor 542 becomes a second predetermined temperature (for example, 160° C.) that is lower than the fixing temperature, part D, part E, and part F are positioned to face exciting coil 120 as shown in FIG. 21A, and uniform heat production distribution is thereby restored.

If a printing operation is performed with narrow paper when fixing unit 19 is cold (for example, at room temperature), heating is started in the state shown in FIG. 21C in order to heat only the paper passage area (medium-width paper passage range). In this case, since only the paper passage area (medium-width paper passage range) is heated, the thermal capacity for heating decreases. Therefore, the temperature can be raised to the predetermined temperature (170° C.) with a small amount of energy, and if heating is performed with the same power, the temperature can be raised in a short time.

Also, since the temperature of fixing belt 112 in the paper non-passage area does not rise to the fixing temperature, it is possible to prevent the temperature of pressure roller 115 in the paper non-passage area from becoming excessively higher than in the paper passage area.

On the other hand, a state is established in which the temperature of temperature sensor 118 is higher than the temperature of temperature sensor 542. If wide paper is next to be fed through in this state, it is necessary to heat only the left-hand end part (the range comprising the maximum-width paper passage range minus the medium-width paper passage range). In this case, part d, part e, and part F are positioned to face exciting coil 120. In the heat production distribution in this state, the calorific value of the right-hand side (the medium-width paper passage range) is small, and the calorific value of the left-hand side (the range comprising the maximum-width paper passage range minus the medium-width paper passage range) is large. By this means it is possible to change from a state in which the temperature of the left-hand side is low to a state of uniform temperature distribution. At this time, the temperature of the paper non-passage area of pressure roller 115 has not risen excessively, and therefore, even when wide paper is fed through, it is possible to prevent irregularities such as uneven glossiness of a fixed image caused by nonuniformity of the temperature of pressure roller 115, enabling high-quality images to be obtained.

As described above, according to this embodiment, the temperature distribution of fixing belt 112 can be kept constantly substantially uniform even when narrow paper or medium-width paper is continuously fed through. Therefore, fixing defects such as cold offset or hot offset due to nonuniformity of fixing temperature distribution can be prevented when wide paper is fed through immediately after narrow paper is fed through, or when narrow paper, medium-width paper, and wide paper are fed through alternately. That is to say, if the entire width of fixing belt 112 is heated during warm-up, it is possible to feed through both narrow paper and wide paper immediately. On the other hand, if only the narrow paper passage range, for example, is heated during warm-up, in the event of an abnormality such as non-rotation of fixing belt 112, the surface temperature of fixing belt 112 will rise steeply and a safety mechanism (such as a thermostat, for example) may not be able to follow. If full-width heating is performed during warm-up, the temperature rise time of fixing belt 112 can be extended, and the follow-up operation of the safety mechanism can be assured.

Also, when starting up for narrow paper or medium-width paper printing, it is possible to heat only the paper passage area, enabling the temperature to be raised with a small amount of energy, and also enabling the temperature to be raised in a short time if heating is performed with the same power.

Furthermore, since opposed core 116 is divided in the axial direction into plural parts each of which is rotatably configured, heating can be performed using any combination of the right-hand, center, and left-hand parts. Therefore, even if the temperature of an end part has become too low relative to that of the center part due to heat dissipation to the end part or the like, uniform temperature distribution can be restored by heating only that end part.

Moreover, as opposed core 116 has a uniform cross-sectional shape in the axial direction, thermal capacity distribution of the heat-producing section is uniform in the axial direction. Therefore, uniform temperature distribution can easily be achieved by performing heating uniformly by means of exciting coil 120.

A paramagnetic substance with a relative permeability of 1 or a conductor such as aluminum may also be used for low-permeability part d, part e, and part f.

Embodiment 6

Figure 23:
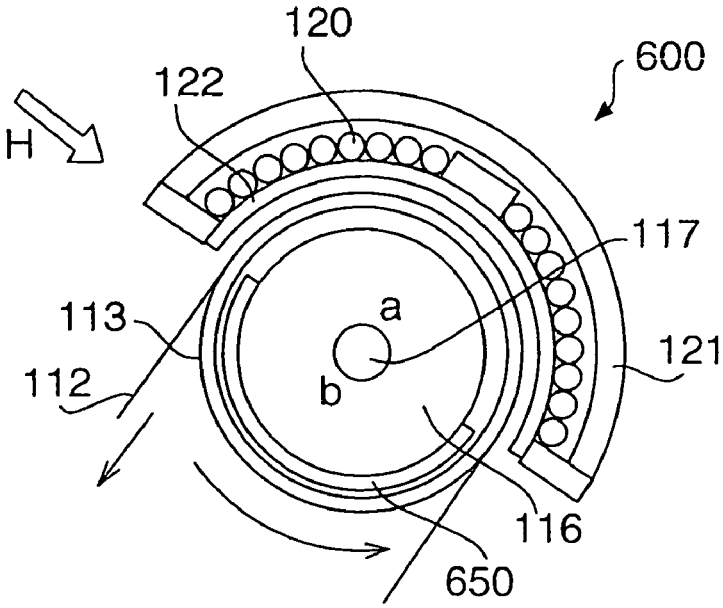
FIG. 23 is a cross-sectional drawing of the principal parts of a fixing unit according to Embodiment 6 of the present invention.
Figure 24:
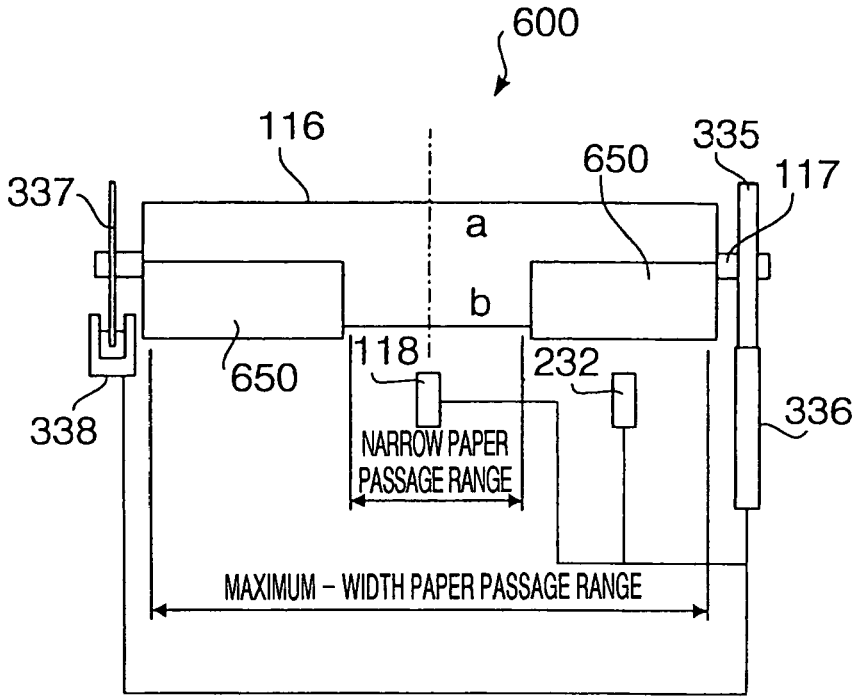
FIG. 24 is a principal-part configuration drawing of a magnetic flux adjustment section viewed from the direction indicated by arrow H in FIG. 23.

FIG. 23 is a cross-sectional drawing of the principal parts of a fixing unit according to Embodiment 6 of the present invention, and FIG. 24 is a principal-part configuration drawing of opposed core 116 constituting a magnetic flux adjustment section viewed from the direction indicated by arrow H in FIG. 23.

This embodiment differs from Embodiment 3 in the configuration of the magnetic flux adjustment section. That is to say, in this embodiment, cylindrical opposed core 116 is regarded as a combination of two semicylinders, one of which is called part a, and the other one part b. Opposed core 116 has a suppression member 650 that covers the part of the outer peripheral surface of part b that corresponds to the narrow paper non-passage area. Suppression member 650 has an arc-shaped outer peripheral surface. Suppression member 650 is made of a nonmagnetic conductive material such as aluminum. The distance between opposed core 116 and the inner peripheral surface of retaining roller 113 is 0.6 mm, and the thickness of suppression member 650 is 0.3 mm.

Other details are similar to Embodiment 2, and configuration elements in this embodiment that have the same action as in Embodiment 2 are assigned the same reference codes as in Embodiment 2, and detailed descriptions thereof are omitted.

The operation and action of opposed core 116 as a magnetic flux adjustment section in this embodiment will now be described.

If the temperature measured by end temperature sensor 232 is lower than a first predetermined temperature (for example, 180° C.) that is higher than the fixing temperature (for example, 170° C.), part a of opposed core 116 is positioned to face exciting coil 120. When current is passed through exciting coil 120 in this state, magnetic flux acts uniformly upon the entire axial-direction width of fixing belt 112, and induction heating is performed uniformly. When recording paper 16 fed through is wide, heat is absorbed over substantially the entire width, and therefore the temperature of fixing belt 112 is maintained uniformly over its entire width.

When narrow recording paper 16 is passed through, heat of only the center part is absorbed by opposed core 116, and together with this, temperature control is performed based on a temperature signal from temperature sensor 118. Therefore, the temperature of both end parts, which are paper non-passage areas, rises. When the temperature measured by temperature sensor 232 exceeds 180° C., opposed core 116 is rotated and part b is positioned to face exciting coil 120. That is to say, suppression member 650 is positioned between parts of fixing belt 112 corresponding to paper non-passage areas and opposed core 116. In this state, an eddy current is induced in suppression member 650, and prevents fluctuation of the magnetic flux that permeates suppression member 650. Through this action, magnetic flux from exciting coil 120 acting upon fixing belt 112 in the paper non-passage areas decreases. Consequently, the magnetic coupling between fixing belt 112 and exciting coil 120 in the paper non-passage areas becomes poorer than for the paper passage area. As a result, heat production distribution of the narrow paper non-passage areas declines, and an excessive rise in the temperature of the paper non-passage areas can be prevented.

Then, when the temperature measured by temperature sensor 232 becomes a second predetermined temperature (for example, 160° C.) that is lower than the fixing temperature, part a of opposed core 116 is positioned to face exciting coil 120 and uniform heat production distribution is restored.

As described above, according to this embodiment, the temperature distribution of fixing belt 112 can be kept constantly substantially uniform even when narrow paper is continuously fed through. Therefore, fixing defects such as cold offset or hot offset due to nonuniformity of fixing temperature distribution can be prevented when wide paper is fed through immediately after narrow paper is fed through, or when narrow paper and wide paper are fed through alternately. That is to say, if the entire width of fixing belt 112 is heated during warm-up, it is possible to feed through both narrow paper and wide paper immediately. On the other hand, if only the narrow paper passage range, for example, is heated during warm-up, in the event of an abnormality such as non-rotation of fixing belt 112, the surface temperature of fixing belt 112 will rise steeply and a safety mechanism (such as a thermostat, for example) may not be able to follow. If full-width heating is performed during warm-up, the temperature rise time of fixing belt 112 can be extended, and the follow-up operation of the safety mechanism can be assured.

With a conventional fixing unit, if the temperature of both ends becomes excessively high when narrow paper is fed through continuously, it is necessary to stop the printing operation and wait until the temperature of both ends falls, or to increase the recording paper feeding interval. With this embodiment, on the other hand, a rise in the temperature of both ends when narrow paper is fed through can be suppressed, making it unnecessary to wait or increase the paper feeding interval in the event of an excessive rise in temperature. Therefore, throughput (the number of sheets output per unit time) can be set high when outputting narrow paper continuously.

As opposed core 116 is rotated as an integral unit, the mechanism for rotational drive is simple. In the case of a configuration in which the center part of the opposed core is fixed, a complex mechanism is necessary in order to rotate only the end parts.

It is desirable for the conductive material of suppression member 650 to have a volume resistivity of not more than $10\times10^{-8}$ Ω·m to prevent heat generation due to induction heating. It is also desirable for its thickness to be not less than 0.2 mm in order to prevent induction heating. As the distance between opposed core 116 and fixing belt 112 at the center is increased by the thickness of suppression member 650, the thinner suppression member 650 is the better. In order to secure sufficient magnetic coupling between exciting coil 120, fixing belt 112, and opposed core 116, it is desirable for the thickness of suppression member 650 to be not more than 2 mm.

Figure 25:
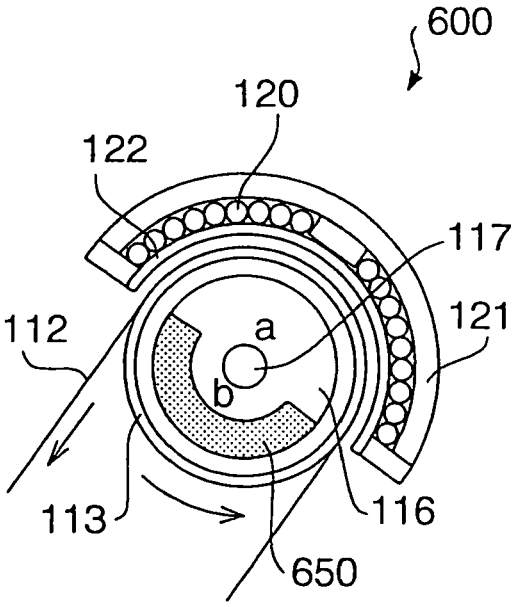
FIG. 25 is a cross-sectional drawing showing a first different sample configuration of a fixing unit according to Embodiment 6 of the present invention.

In this embodiment, the cross-sectional shape of opposed core 116 is uniformly cylindrical in the axial direction. However, the shape of opposed core 116 is not limited to this. For example, a recess may be provided in the part of the outer peripheral surface of part b of opposed core 116 corresponding to a paper non-passage area, and suppression member 650 may be fitted in this recess, as shown in FIG. 25. Providing a recess in opposed core 116 in this way simplifies positioning when fitting suppression member 650, and so simplifies assembly. Suppression member 650 is fitted so that its outer peripheral surface is located on the same circumferential surface as the outer peripheral surface of opposed core 116. By locating the outer peripheral surface of opposed core 116 and the outer peripheral surface of suppression member 650 on the same circumferential surface in this way, the distance from retaining roller 113 to opposed core 116 and the distance from retaining roller 113 to suppression member 650 are made equal—that is, heat conduction from retaining roller 113 to opposed core 116 and heat conduction from retaining roller 113 to suppression member 650 are made equal—making it possible to prevent temperature nonuniformity of fixing belt 112. Moreover, in this case, the distance between opposed core 116 and fixing belt 112 is reduced by the thickness of suppression member 650, enabling magnetic coupling between exciting coil 120, fixing belt 112, and opposed core 116 to be increased.

Figure 26:
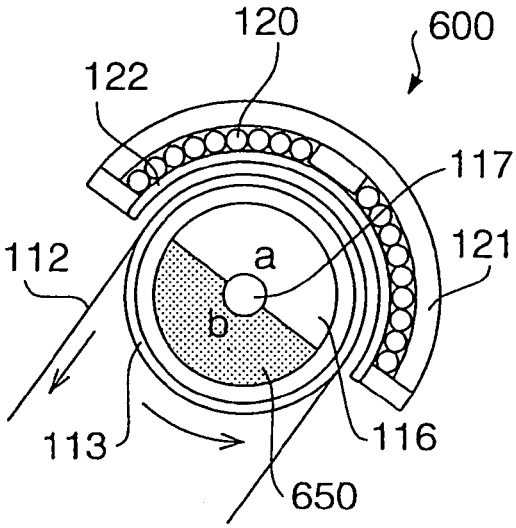
FIG. 26 is a cross-sectional drawing showing a second different sample configuration of a fixing unit according to Embodiment 6 of the present invention.
Figure 27:
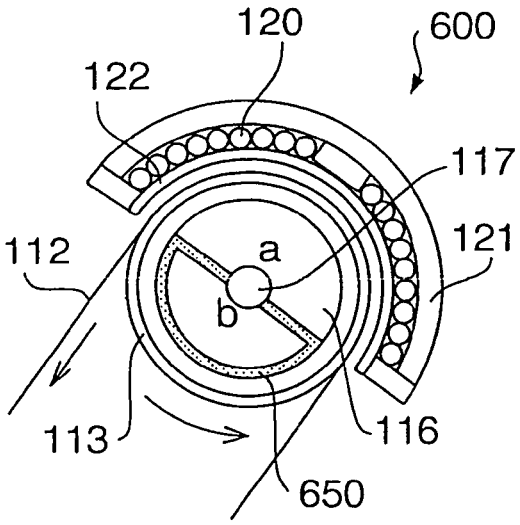
FIG. 27 is a cross-sectional drawing showing a third different sample configuration of a fixing unit according to Embodiment 6 of the present invention.

An opposed core 116 of the shape described in Embodiment 3 may be used, and suppression member 650 may be provided at both ends of this opposed core 116 (parts having a semicylindrical shape), as shown in FIG. 26. In this case, the same kind of effect as described above can be obtained by having the outer peripheral surface of suppression member 650 located on the same circumferential surface as the outer peripheral surface of opposed core 116. The same kind of effect can also be obtained if suppression member 650 is a hollow semicylinder as shown in FIG. 27.

Figure 28:
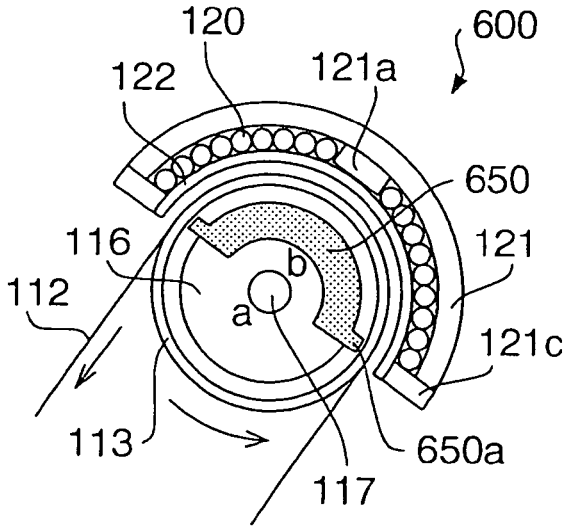
FIG. 28 is a cross-sectional drawing showing a fourth different sample configuration of a fixing unit according to Embodiment 6 of the present invention.

Suppression member 650 shown in FIG. 28 has a configuration in which a projection 650*a* is provided at either circumferential end of suppression member 650 shown in FIG. 25. This enables wraparound of magnetic flux reaching front cores 121*c* from center core 121*a* via fixing belt 112 to be suppressed, enabling heat production to be reduced effectively.

Figure 12:
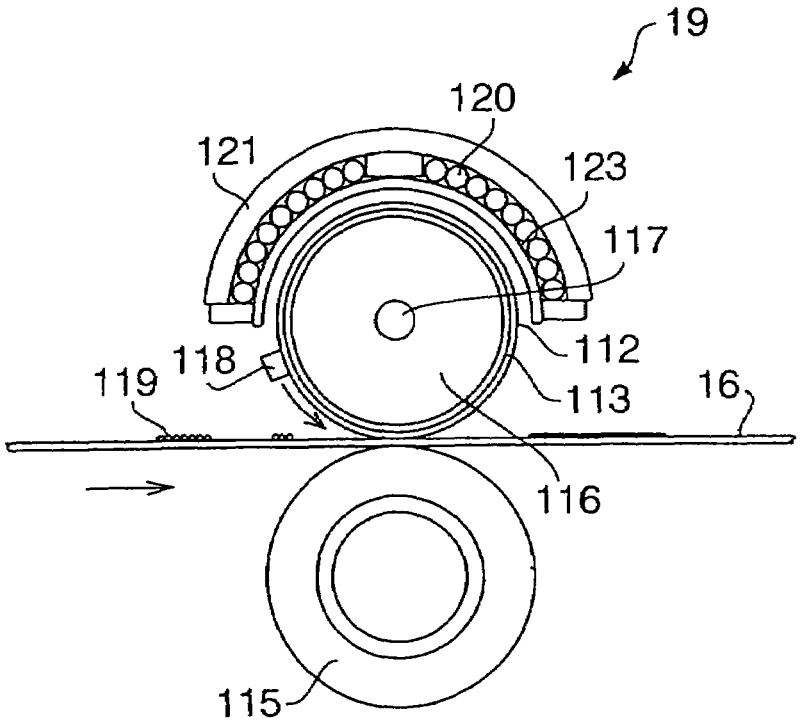
FIG. 12 is a cross-sectional drawing showing a fourth different sample configuration of a fixing unit according to Embodiment 1 of the present invention.
Figure 29:
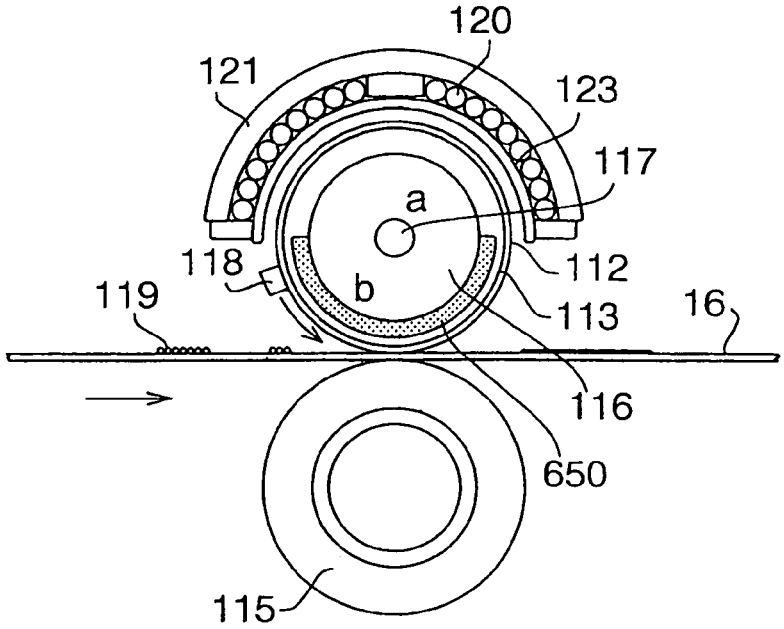
FIG. 29 is a cross-sectional drawing showing a fifth different sample configuration of a fixing unit according to Embodiment 6 of the present invention.

It is also possible to apply a combination of opposed core 116 and suppression member 650 described in this embodiment to the configuration described using FIG. 12 in Embodiment 1, as shown in FIG. 29. The same kind of effect can be achieved in this case as with the configuration shown in FIG. 12.

In the prior art, suppression member 650 has been located between exciting coil 120 and fixing belt 112. In this embodiment, on the other hand, suppression member 650 is located on the opposite side of fixing belt 112 from exciting coil 120. By this means, the current and voltage induced in the suppression coil are made small, and a rise in the temperature of suppression member 650 is suppressed. Also, the thickness of suppression member 650 does not affect the distance between fixing belt 112 and exciting coil 120, enabling suppression member 650 to be made fully as thick as necessary. Furthermore, as suppression member 650 is attached to opposed core 116 made of ferrite that has thermal conductivity of a predetermined level or above, heat dissipation from suppression member 650 can be performed efficiently. That is to say, from these points of view, it can be said to be possible to suppress a rise in the temperature of suppression member 650. As a result, induction heating energy consumed by suppression member 650 can be suppressed, enabling thermal efficiency for heating fixing belt 112 to be improved and temperature rises of suppression member 650 to be suppressed, thereby making it possible to perform continuous feeding of narrow paper.

In this embodiment, opposed core 116 is assumed to be an integral unit, but opposed core 116 may also be divided in the axial direction in the same way as in Embodiment 5.

In the above embodiment, the rotational phase of opposed core 116 is switched based on a temperature signal from temperature sensor 232. However, the basis for phase switching is not limited to this, and the rotational phase may also be switched according to the width of recording paper 16, for example.

Embodiment 7

Figure 30:
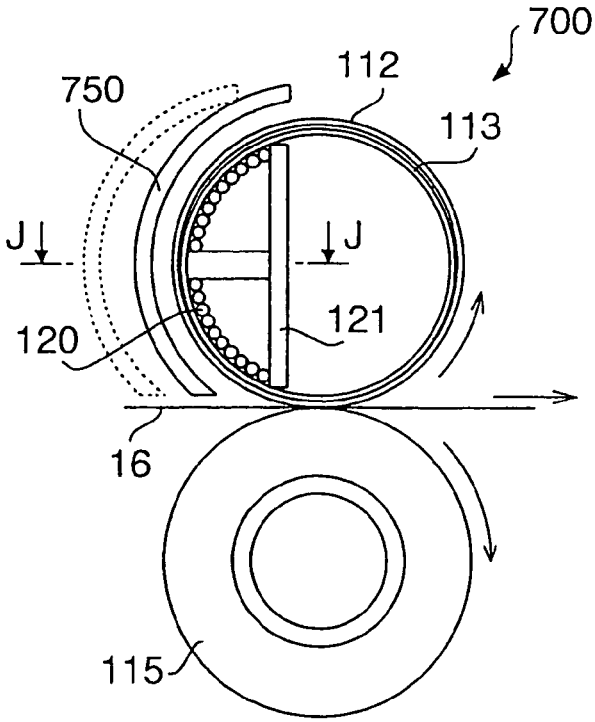
FIG. 30 is a cross-sectional drawing of a fixing unit according to Embodiment 7 of the present invention.
Figure 31:
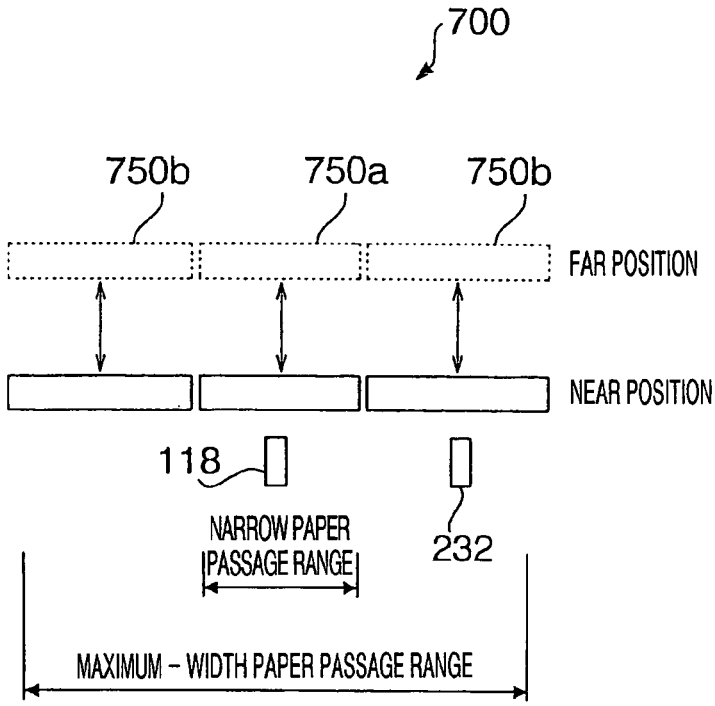
FIG. 31 is a principal-part configuration drawing of a magnetic flux adjustment section in the fixing unit in FIG. 30.

FIG. 30 is a cross-sectional drawing of the principal parts of a fixing unit according to Embodiment 7 of the present invention, and FIG. 31 is a principal-part configuration drawing along line J-J of an opposed core constituting a magnetic flux adjustment section in the fixing in FIG. 30.

This embodiment differs from Embodiment 6 in the configuration of fixing unit 19. That is to say, as shown in the drawings, exciting coil 120 is installed inside retaining roller 113, retaining roller 113 is pressed against pressure roller 115 via fixing belt 112, and an approximately arc-shaped suppression member 750 is positioned to closely face the outer peripheral surface of fixing belt 112.

Suppression member 750 is divided into three in the axial direction, being composed of a suppression member 750*a* and two suppression members 750*b*. Suppression member 750*a* is located in the center in the axial direction, and suppression members 750*b* are located at either side in the axial direction. The division locations correspond to the two edges of a predetermined narrow paper passage range. Suppression member 750 is made of 1.5 mm thick aluminum sheet. Suppression members 750*a* and 750*b* are supported movably in the radial direction of fixing belt 112. Suppression members 750*a* and 750*b* are displaced between a near position at a distance of 0.5 mm from fixing belt 112 and a far position at a distance of 4 mm from fixing belt 112.

Other details are similar to Embodiment 6, and configuration elements in this embodiment that have the same action as in Embodiment 6 are assigned the same reference codes as in Embodiment 6, and detailed descriptions thereof are omitted.

The operation and action of suppression member 750 as a magnetic flux adjustment section in this embodiment will now be described.

If the temperature difference between center temperature sensor 118 and end temperature sensor 232 is less than a predetermined temperature difference (for example, 15° C.), and the temperature measured by temperature sensor 232 is lower than a first predetermined temperature (for example, 180° C.) that is higher than the fixing temperature (for example, 170° C.), both suppression member 750*a* and suppression members 750*b* are displaced to the far positions shown by the dotted lines in FIG. 31. When current is passed through exciting coil 120 in this state, magnetic flux acts uniformly upon the entire axial-direction width of fixing belt 112, and induction heating is performed uniformly. When recording paper 16 fed through is wide, heat is absorbed over substantially the entire width, and therefore the temperature of fixing belt 112 is maintained uniformly over its entire width.

When narrow recording paper 16 is passed through in this state, heat of only the center part is absorbed by the recording paper, and together with this, temperature control is performed based on a temperature signal from center temperature sensor 118. Therefore, the temperature of both end parts, which are paper non-passage areas, rises. When the temperature measured by temperature sensor 232 exceeds 180° C., suppression members 750*b* at both ends are displaced to the near positions shown by the solid lines in FIG. 31. With these suppression members 750*b* at both ends brought near to fixing belt 112, the magnetic coupling between fixing belt 112 and exciting coil 120 in the paper non-passage areas becomes poorer than for the paper passage area, and magnetic flux from exciting coil 120 acting upon fixing belt 112 in the paper non-passage areas decreases. As a result, heat production distribution of the narrow paper non-passage areas declines, and an excessive rise in the temperature of the paper non-passage areas can be prevented.

Then, when the temperature measured by temperature sensor 232 becomes a second predetermined temperature (for example, 160° C.) that is lower than the fixing temperature, suppression members 750*b* at both ends are moved to their far positions and uniform heat production distribution is restored.

If a printing operation is performed with narrow paper when fixing unit 19 is cold (for example, at room temperature), heating is started with suppression members 750*b* at both ends in their near positions. At this time, since only the center part is heated with high intensity heat production distribution, the thermal capacity for heating decreases. Therefore, the temperature can be raised to the predetermined temperature (170° C.) with a small amount of energy, and if heating is performed with the same power, the temperature can be raised in a short time.

At this time, also, a state is established in which the temperature of center temperature sensor 118 is higher than that of end temperature sensor 232. If wide paper is next to be fed through in this state, it is necessary to heat only both end parts. For example, when the temperature difference between temperature sensor 118 and temperature sensor 232 reaches a predetermined value (for example, 15° C.) or more, center-part suppression member 750*a* is displaced to the near position and end-part suppression members 750*b* are displaced to the far position. In the heat production distribution in this state, the calorific value of the center part is small, and the calorific value of the end parts is large. By this means it is possible to change from a state in which the temperature of the end parts is low to a state of uniform temperature distribution.

Also, by locating electrically conductive suppression member 750 on the outside of fixing belt 112, leakage of magnetic flux outside fixing unit 19 can be prevented.

As described above, according to this embodiment, the temperature distribution of fixing belt 112 can be kept constantly substantially uniform even when narrow paper is continuously fed through. Therefore, fixing defects such as cold offset or hot offset due to nonuniformity of fixing temperature distribution can be prevented when wide paper is fed through immediately after narrow paper is fed through, or when narrow paper and wide paper are fed through alternately. That is to say, if the entire width of fixing belt 112 is heated during warm-up, it is possible to feed through both narrow paper and wide paper immediately. On the other hand, if only the narrow paper passage range, for example, is heated during warm-up, in the event of an abnormality such as non-rotation of fixing belt 112, the surface temperature of fixing belt 112 will rise steeply and a safety mechanism (such as a thermostat, for example) may not be able to follow. If full-width heating is performed during warm-up, the temperature rise time of fixing belt 112 can be extended, and the follow-up operation of the safety mechanism can be assured.

Also, when starting up for narrow paper printing, it is possible to heat only the center part, enabling the temperature to be raised with a small amount of energy, and also enabling the temperature to be raised in a short time if heating is performed with the same power. Furthermore, uniform temperature distribution can be restored even when the temperature of the end parts has become too low relative to that of the center part due to heat dissipation to the end parts or the like.

In the prior art, suppression member 750 has been located between exciting coil 120 and fixing belt 112. In this embodiment, on the other hand, suppression member 750 is located on the opposite side of fixing belt 112 from exciting coil 120.

By this means, the current and voltage induced in the suppression coil are made small, and a rise in the temperature of suppression member 750 is suppressed. Also, the thickness of suppression member 750 does not affect the distance between fixing belt 112 and exciting coil 120, enabling suppression member 750 to be made fully as thick as necessary. That is to say, from this point of view, it can be said to be possible to suppress arise in the temperature of suppression member 750. As a result, induction heating energy consumed by suppression member 750 can be suppressed, enabling thermal efficiency for heating fixing belt 112 to be improved and temperature rises of suppression member 750 to be suppressed, thereby making it possible to perform continuous feeding of narrow paper.

Figure 32:
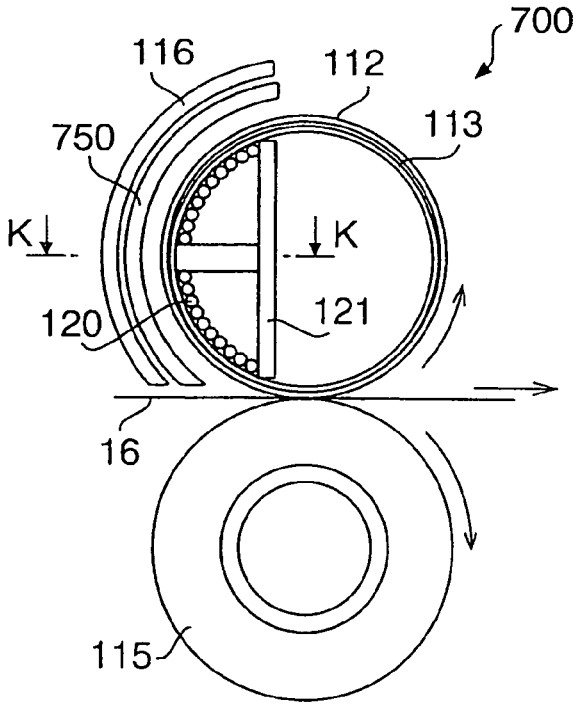
FIG. 32 is a cross-sectional drawing showing a different sample configuration of a fixing unit according to Embodiment 7 of the present invention.
Figure 33:
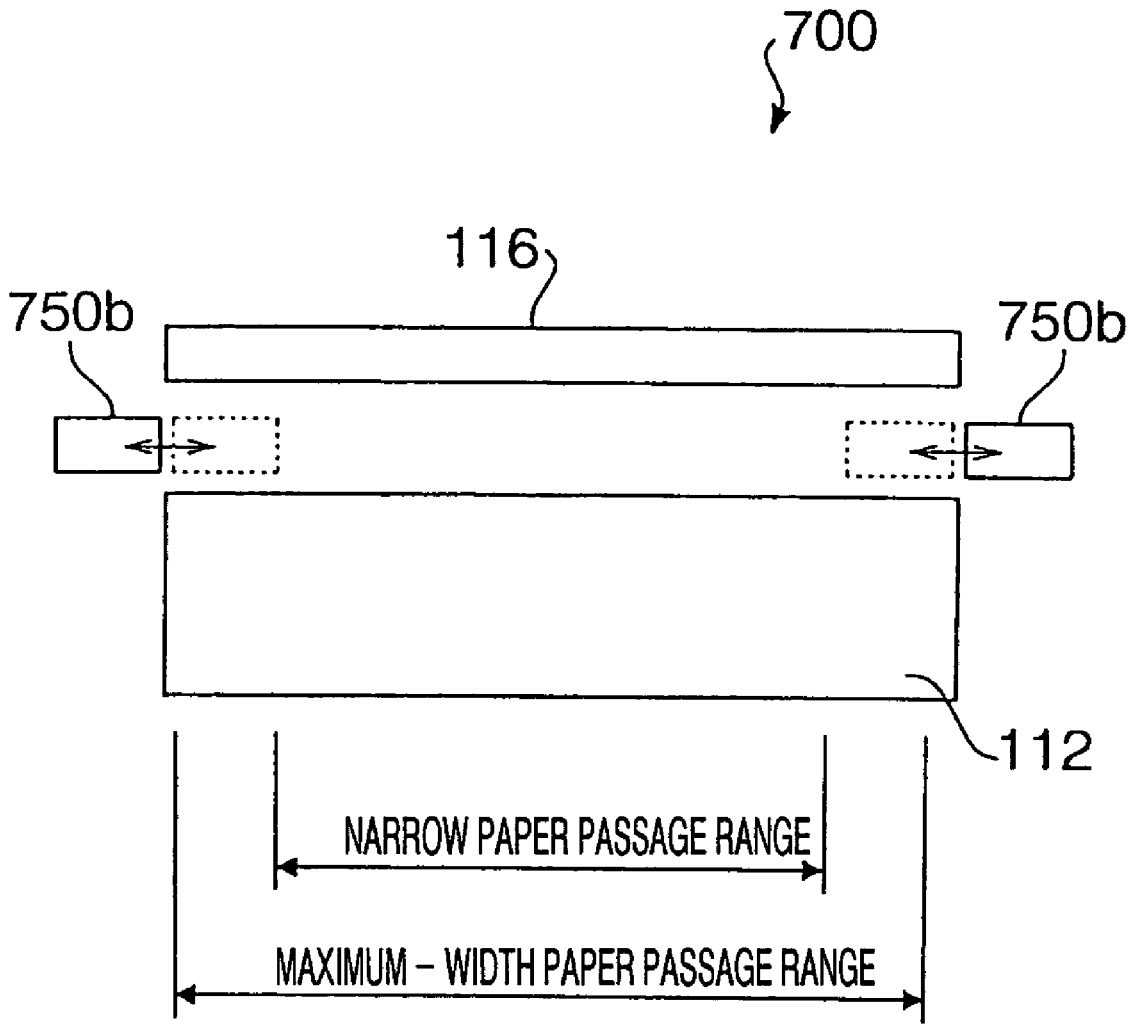
FIG. 33 is a principal-part configuration drawing of a magnetic flux adjustment section in the fixing unit in FIG. 32.

In this embodiment, suppression member 750 is configured movably in the radial direction of fixing belt 112, but suppression member 750 is not limited to this configuration. For example, two suppression members 750*b* that are movable in the axial direction may be provided at both end parts comprising paper non-passage areas—that is, the ranges resulting from excluding the narrow paper passage range from the maximum-width paper passage range—as shown in FIG. 32 and FIG. 33. In FIG. 33, opposed core 116 is located on the opposite side of suppression members 750*b* from fixing belt 112.

In the case of this configuration, suppression members 750*b* are moved outside the maximum-width paper passage range to provide uniform heat production distribution, and are moved to positions corresponding to the width of recording paper 16 fed through to lower the heat production distribution of the paper non-passage areas at both ends. By this means, the width of low heat production distribution areas can be set continuously and arbitrarily. As a result, an excessive rise in the temperature of paper non-passage areas can be prevented for any width of recording paper 16 fed through.

The configuration of fixing unit 19 of the present invention is not limited to the above-described configurations, and application is also possible to cases where exciting coil 120 is provided on both the outer peripheral surface side and inner peripheral surface side of fixing belt 112.

As described above, according to the present invention the entire width of a heat-producing member can be heated uniformly and an excessive rise in the temperature of the heat-producing member can be prevented, without making the configuration complex.

This application is based on Japanese Patent Application No. 2003-002058 filed on Jan. 18, 2003, the entire content of which is expressly incorporated by reference herein.

INDUSTRIAL APPLICABILITY

An image heating apparatus and image forming apparatus of the present invention have an effect of heating the entire width of a heat-producing member uniformly and preventing an excessive rise in the temperature of the heat-producing member, without making the configuration complex, and are useful as an image heating apparatus using an electromagnetic induction heating scheme for fixing an unfixed image, and an image forming apparatus such as an electrophotographic apparatus or electrostatographic apparatus.

The invention claimed is:

1. An image heating apparatus comprising:

an annular heat-producing member having an inner peripheral surface and an outer peripheral surface that produce heat based on a magnetic flux;

a coil facing the outer peripheral surface that generates magnetic flux that acts upon said heat-producing member; and a magnetic flux reduction section facing the inner peripheral surface and attached to a rotatable core which is made of a ferromagnetic material and is rotatably arranged inside the annular heat-producing member, said magnetic flux reduction section reducing, of the magnetic flux generated by said coil, magnetic flux that acts upon a paper non-passage area of said heat-producing member, wherein the magnetic flux reduction section is displaced between a first position in which the magnetic flux that acts upon the paper non-passage area is reduced and a second position in which the magnetic flux that acts upon the paper non-passage area is not reduced, by rotating said core.

2. The image heating apparatus according to claim 1, wherein:

said core has a recess formed in an outer peripheral surface of said core; and said magnetic flux reduction section is attached by being inserted in said recess.

3. The image heating apparatus according to 1, wherein said magnetic flux reduction section is attached to said core so that an outer peripheral surface of said magnetic flux reduction section is located on a circumferential surface the same as an outer peripheral surface of said core.

4. The image heating apparatus according to claim 1, wherein said magnetic flux reduction section has a projection formed on a peripheral-direction end of said magnetic flux reduction section.

5. The image heating apparatus according to claim 1, wherein said magnetic flux reduction section is displaced to the second position at a warm-up time.

6. The image heating apparatus according to claim 1, wherein said magnetic flux reduction section is first displaced to the second position and thereafter displaced to the first position when sheets narrower than a maximum-width paper passage range are passed through continuously.

7. The image heating apparatus according to claim 1, wherein said core has thermal conductivity of a predetermined level or above.

8. An image forming apparatus that has the image heating apparatus according to claim 1.

9. An image heating apparatus according to claim 1, wherein said magnetic flux reduction section covers a partial area of an outer peripheral surface of said core.

* * * * *